US012117274B2

(12) United States Patent
Blauer

(10) Patent No.: US 12,117,274 B2
(45) Date of Patent: Oct. 15, 2024

(54) FRONT OPENING BALLISTIC VEST CARRIER COVER

(71) Applicant: Blauer Manufacturing Company, Inc., Boston, MA (US)

(72) Inventor: Stephen J Blauer, Lexington, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 160 days.

(21) Appl. No.: 17/653,360

(22) Filed: Mar. 3, 2022

(65) Prior Publication Data

US 2022/0290945 A1 Sep. 15, 2022

Related U.S. Application Data

(60) Provisional application No. 63/159,155, filed on Mar. 10, 2021.

(51) Int. Cl.

| | |
|---|---|
| ***F41H 5/013*** | (2006.01) |
| ***A41D 13/05*** | (2006.01) |
| *A41D 1/04* | (2006.01) |

(52) U.S. Cl.

CPC ..... *F41H 5/013* (2013.01); *A41D 13/0518* (2013.01); *A41D 1/04* (2013.01)

(58) Field of Classification Search

CPC ..... A41D 13/0518; A41D 1/04; F41H 5/013
USPC ..... 2/2, 2.5
See application file for complete search history.

(56) References Cited

U.S. PATENT DOCUMENTS

| | | | | |
|---|---|---|---|---|
| 642,649 A * | 2/1900 | Vaughan | F41H 1/02 152/196 |
| 1,739,112 A * | 12/1929 | Wisbrod | F41H 1/02 152/196 |
| 3,452,362 A * | 7/1969 | Korolick | F41H 1/02 2/92 |
| 3,843,969 A | 10/1974 | George et al. | |
| 4,266,297 A | 5/1981 | Atkins | |

(Continued)

FOREIGN PATENT DOCUMENTS

EP 1772697 A2 11/2007

OTHER PUBLICATIONS

American Body Armor, Uniform Carrier, 2009.

(Continued)

*Primary Examiner* — Khaled Annis
*Assistant Examiner* — Dakota Marin
(74) *Attorney, Agent, or Firm* — Altman & Martin; Steven K Martin

(57) ABSTRACT

A ballistic vest carrier cover having a mantle with a center rear panel, a front panel attached to the right side of the rear panel forming a right arm hole, and a front overlay attached to the left side of the rear panel forming a left arm hole. The cover is donned like a jacket with the rear panel covering the back of the torso, the front panel covering the front of the torso, and the front overlay covering the left half of the front panel. The front overlay is removably attached to the front panel by a vertical zipper that is optionally hidden by a false placket. A fabric outer layer and liner are attached to form a front and rear pockets for body armor panel carriers. The mantel has optional front and rear hard armor pouches inside the front and rear armor pockets, respectively, and optional side pouches.

6 Claims, 25 Drawing Sheets

(56) References Cited

U.S. PATENT DOCUMENTS 4,485,491 A * 12/1984 Rasmussen ..... F41H 1/02 2/2.5
5,157,792 A 10/1992 Allen et al.
5,331,683 A 7/1994 Stone et al.
5,697,098 A * 12/1997 Miguel-Bettencourt ..... A41D 31/245 2/2.5
6,066,017 A 5/2000 Max et al.
6,098,196 A * 8/2000 Logan ..... F41H 1/02 2/2.5
6,526,862 B1 3/2003 Lyons
6,681,399 B1 * 1/2004 Kerr ..... A41D 13/0125 2/2.5
7,546,853 B2 * 6/2009 Rock ..... A41D 27/28 2/2.5
8,370,962 B2 * 2/2013 McBride ..... F41H 1/02 2/2.5
8,528,112 B2 * 9/2013 Blauer ..... F41H 1/02 2/92
8,776,262 B2 * 7/2014 Blauer ..... F41H 1/02 2/92
9,835,414 B2 * 12/2017 Blauer ..... A41D 27/02
10,139,199 B2 * 11/2018 Blauer ..... A41D 1/04
10,254,086 B2 4/2019 Ballesteros Casas
10,485,272 B2 * 11/2019 Blauer ..... A41D 27/02
2001/0050492 A1 12/2001 Janevski
2006/0037121 A1 * 2/2006 Park ..... F41H 5/0485 2/2.5
2008/0235841 A1 * 10/2008 McDunn ..... F41H 1/02 2/2.5
2008/0263737 A1 10/2008 Parks et al.
2009/0151036 A1 * 6/2009 Joseph ..... F41H 1/02 2/243.1
2009/0282595 A1 * 11/2009 Branson ..... F41H 1/02 2/2.5
2010/0162459 A1 * 7/2010 Bronstein ..... F41H 1/02 2/2.5
2011/0209260 A1 9/2011 Herbener et al.
2012/0132066 A1 5/2012 Seuk
2012/0180205 A1 7/2012 Herring
2013/0081195 A1 * 4/2013 Faridoon ..... A41D 1/04 2/102
2017/0234654 A1 * 8/2017 Beck ..... F41H 5/04 2/2.5
2021/0339069 A1 * 11/2021 Coughlan ..... A41D 1/04
2023/0145266 A1 * 5/2023 Pittman ..... A41D 13/0518 2/2.5

OTHER PUBLICATIONS

Armor Express, Lighthawk XT, 2013.
Diamondback Tactical, Viking Enforcer, 2014.
Point Blank Armor, Tailored Armor Carrier, 2010.
Point Blank Enterprises, Plate Carrier, 2013.
Protech Tactical, Titan Assault Enhanced, 2011.
Second Chance Body Armor, Tactical Assault Carrier, 2014.
Office Action for U.S. Appl. No. 13/367,262 dated Apr. 12, 2013.
Office Action for U.S. Appl. No. 14/093,243 dated Jan. 31, 2014.
Office Action for U.S. Appl. No. 15/015,442 dated Jun. 28, 2017.
Office Action for U.S. Appl. No. 15/372,517 dated Jun. 14, 2018.
Office Action for U.S. Appl. No. 15/816,344 dated Oct. 2, 2019.

* cited by examiner

FRONT OPENING BALLISTIC VEST CARRIER COVER

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to police equipment, more particularly, to outer carrier wearing of soft body armor, law enforcement duty belts and methods for suspending them.

2. Description of the Related Art

Standard equipment for peace officers includes the wearing of an undershirt or turtleneck, a ballistic soft body armor vest, and a police uniform shirt over the vest. The soft body armor vest includes a carrier, two soft armor panels, and attachable/detachable fasteners, typically hook and loop fasteners. One armor panel fits into a front carrier through an opening in the bottom of the front carrier and the other armor panel fits into a rear carrier through an opening in the bottom of the rear carrier. The attachable/detachable fasteners attach the front and rear carriers together around the wearer's waist and over the shoulders to form the vest.

The soft body armor vest traps excess body heat around the torso in warm weather and is uncomfortable due to the constant compression and weight of the armor. It is also very inconvenient to remove the soft body armor vest prior to the conclusion of the wearer's shift. For this reason, there has been a move towards the wearing of outer carrier ballistic vests.

Most outer carrier vests are made from heavy-duty nylon or polyester materials and are fitted to a particular brand of soft body armor panels. The panels are removed from the front and rear carriers, which are no longer needed, and inserted into the bottom of the carrier vest. The carrier vest has attachable/detachable, typically hook and loop, fasteners at the sides for adjustment and removal. Use of the carrier vest's fasteners rather than those supplied by the manufacturer with the soft body armor panels may void the armor warranty. The carrier vests are made to somewhat match the look of a uniform shirt on the outside and are typically worn over a police shirt.

There are occasional situations where additional armor protection is desired. The additional protection can take the form of hard armor plates covering the front and rear torso. Typically, the hard armor plates are installed in pouches in the carrier vest. Current versions of such carrier vests, such as those described in U.S. Pat. Nos. 9,835,414, 10,139,199, and 10,485,272, are designed to fit over the head rather than be donned like a jacket, making donning and doffing the carrier vest cumbersome. Further, the fastening the soft armor side straps and the side zippers is awkward, especially for larger and less flexible wearers. The side zippers are not covered, which means they can be pulled open, and the entire carrier cover pulled over the wearer's head. The side zippers can interfere with placing equipment in the desired locations on the duty belt.

BRIEF SUMMARY OF THE INVENTION

The ballistic vest carrier cover of the present invention is an improvement over prior art designs in that the carrier cover that is donned like a jacket, rather than over the head, while providing full torso protection.

The cover has a mantle with a front panel, a rear panel, and a front overlay. The rear panel is in the center, the front panel is attached to the right side of the rear panel by a right side panel, and the front overlay is attached to the left side of the rear panel by a left side panel. The front panel is attached to the rear panel at the right shoulder and the front overlay is attached to the rear panel at the left shoulder. There is a right arm hole between the rear panel and the front panel and a left arm hole between the rear panel and the front overlay.

When worn, the rear panel covers the back of the torso, the front panel covers the front of the torso, and the front overlay covers approximately the left half of the front panel and is removably attached to the front panel by a vertical fastener such as a zipper.

The mantle has a fabric outer layer, an optional interlining to protect the outer layer from abrasion from the body armor panel carriers, and a liner that is typically a polyester mesh. The liner is attached to the outer layer to form a front pocket and a rear pocket that receive the body armor panel carriers. Side armor openings and optional lateral openings provide access to the pockets. The armor openings allow the use of the body armor waist straps that are supplied with the body armor for individual adjustment. The front and rear panel carriers are attached together at the shoulders using the body armor shoulder straps supplied with the body armor.

Optionally, the mantel has a front pouch and a rear pouch inside the front and rear armor pockets, respectively, with access from the outside of the carrier cover for installing hard armor. Optional side pouches are in the side panels of the cover.

In one configuration, the pouch is a single fabric sheet attached to the outer layer around the sheet perimeter. In another configuration, the pouch is a bag that hangs in the pocket. In another configuration, the pouch is a bag closed on top that hangs from the shoulders within the pocket.

In one configuration, the pouch is accessed via a lateral opening in the outer layer. In another configuration, the front pouch is accessed via a vertical opening in the outer layer. Optionally, the opening and its fastener are hidden behind or on the edge of a placket.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporates by reference in its entirety U.S. Provisional Patent Application No. 63/159,155, on which this application is based.

The present invention is a ballistic vest carrier cover that has pockets for soft body armor panels (herein after, soft armor panels or armor panels) in carriers and pouches for hard body armor plates (herein after, hard armor plates or armor plates), and that is donned like a jacket.

Figure 1:
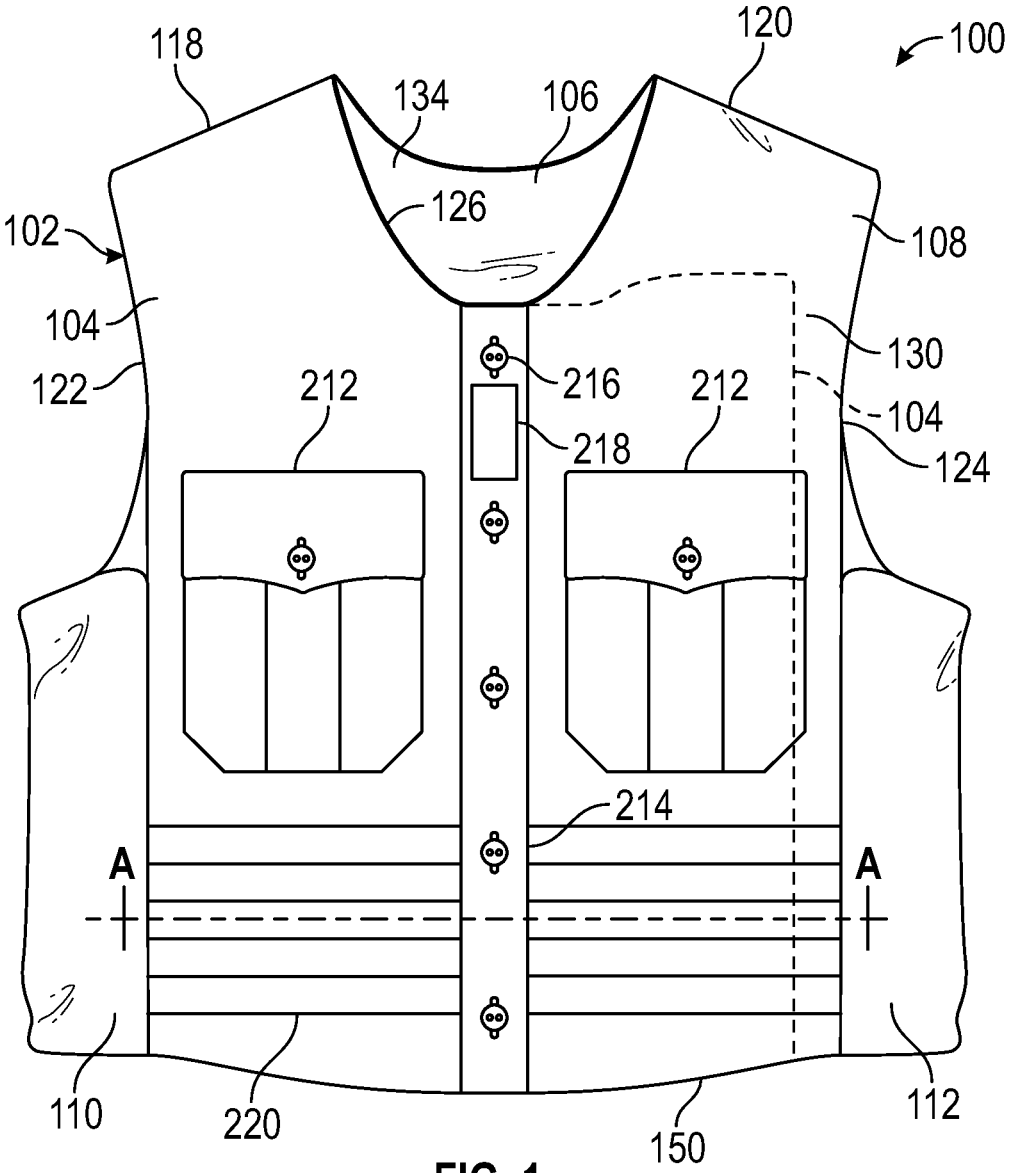
FIG. 1 is a front, partial phantom view of the ballistic vest carrier cover of the present invention showing several options.
Figure 2:
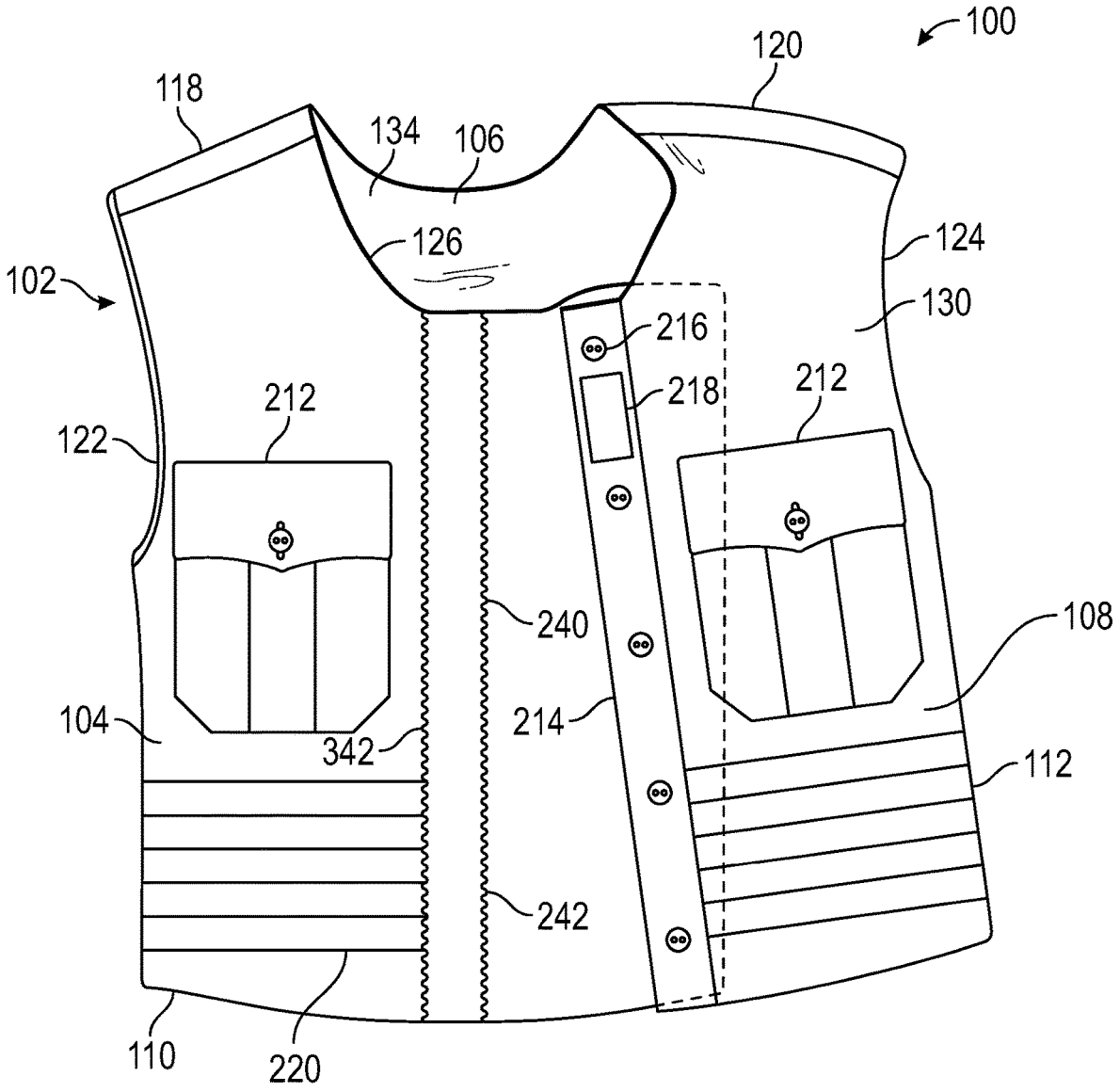
FIG. 2 is a perspective view of the carrier cover of FIG. 1 partially open.

As shown in FIGS. 1 and 2, the ballistic vest carrier cover 100 of the present invention has a mantle 102 with a front panel 104, a rear panel 106, and a front overlay 108. From the point of view of a person wearing the carrier cover 100, the rear panel 106 is in the center, the front panel 104 is attached to the right side of the rear panel 106 by a right side panel 110, and the front overlay 108 is attached to the left side of the rear panel 106 by a left side panel 112. The front panel 104 is attached to the rear panel 106 at the right shoulder 118 and the front overlay 108 is attached to the rear panel 106 at the left shoulder 120.

A right arm opening 122 is delimited by the front panel 102, rear panel 106, and right side panel 110. A left arm opening 124 is delimited by the front overlay 108, rear panel 106, and left side panel 112. A neck opening 126 is delimited by the front panel 102, rear panel 106, and front overlay 108.

The present specification presumes the arrangement described above, but the present invention contemplates a mirror image arrangement, that is, with the front panel 104 on the left side of the rear panel 106 and the front overlay 108 on the right side of the rear panel 106.

In order to keep confusion to a minimum and to accommodate the two possible mirror image arrangements of the cover 100 of the present invention, the terms, "right" and "left", will continue to be used, but where "right" refers to the side of the rear panel 106 to which the front panel 104 is attached and "left" refers to the side of the rear panel 106 to which the front overlay 108 is attached. The drawings illustrate the arrangement wherein "right" and "left" are as shown.

When being worn by a wearer, the rear panel 106 covers the back of the wearer's torso, the front panel 104 covers the front of the wearer's torso, and the front overlay 108 covers approximately the left half of the front panel 104, as described below. The front overlay 108 is removably attached to the front panel 102, as described below.

The present invention is an improvement over prior art designs in that the carrier cover can be donned like a jacket while providing full torso protection.

Figure 3:
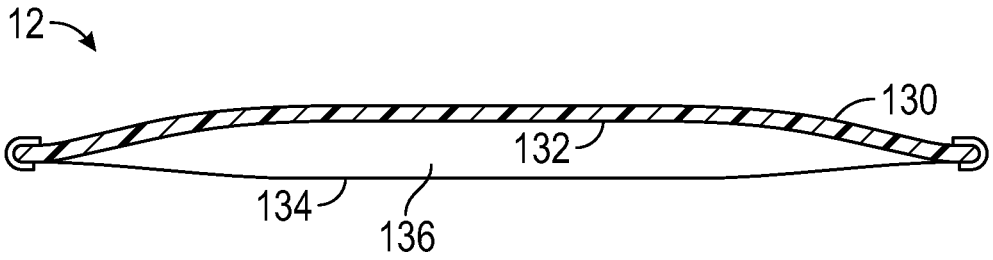
FIG. 3 is a cross-sectional view of one fabric structure of the carrier cover taken at A-A of FIG. 1.

The mantle 102 has a fabric outer layer 130 and an optional interlining 132, as shown in FIG. 3. The optional interlining 132 has a thermoplastic adhesive that is activated by pressing or fusing machine rollers to heat-fuse the interlining 132 to the back of the outer layer 130. Typically, the interlining 132 is a lightweight tricot, woven or unwoven. The interlining 132 protects the outer layer 130 from abrasion from the soft armor panel carriers 12, 14, thereby providing strength and durability to the carrier 100. It also improves the appearance of the carrier 100 by providing stability to the outer layer 130.

Figure 4:
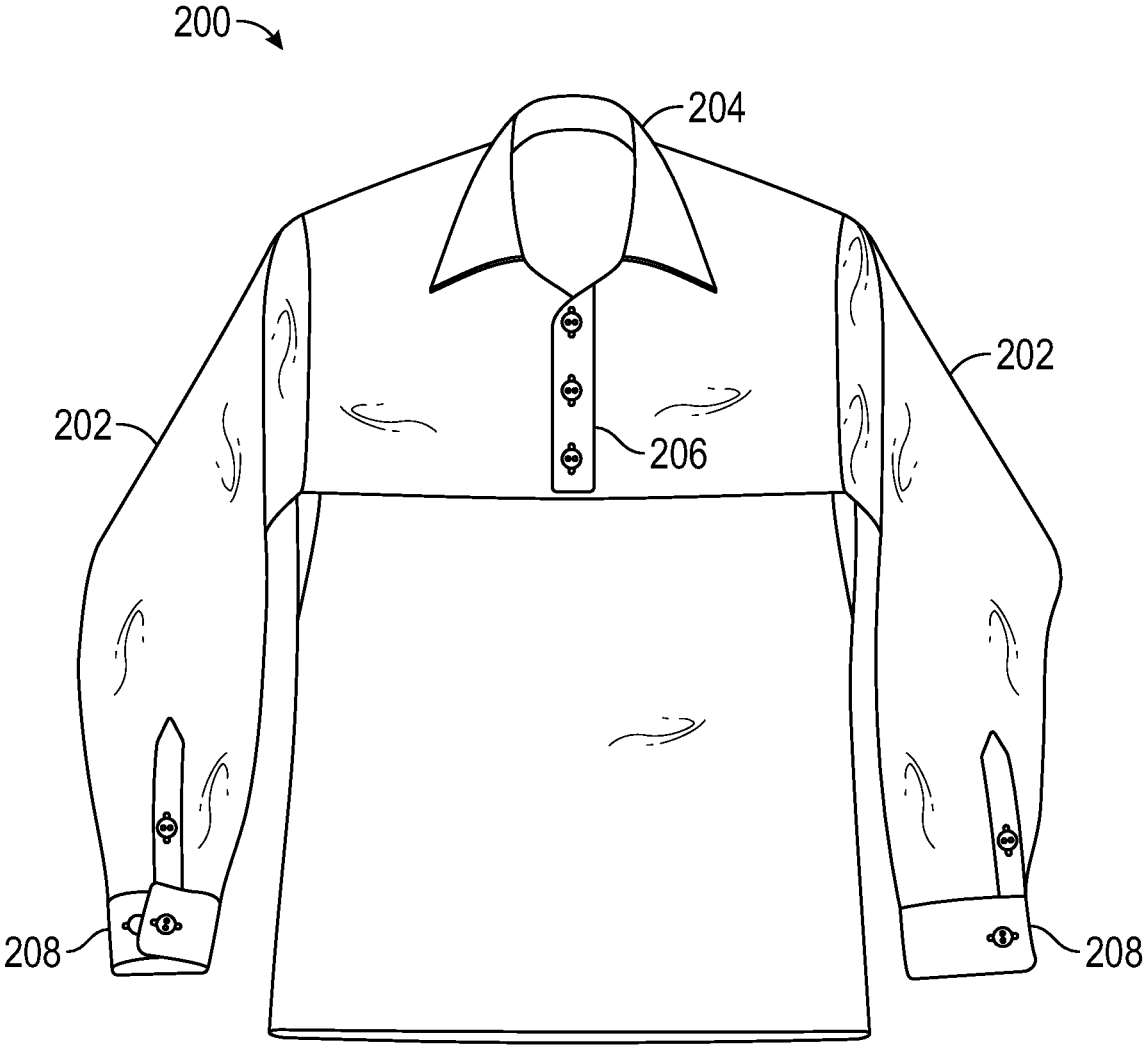
FIG. 4 is a perspective view of a long-sleeve pullover shirt for use with the carrier cover of the present invention.

The carrier cover 100 is designed to fit over a pullover shirt 200 with color-matched short or long sleeves 202, a collar 204, an optional false placket 206, and optional cuffs 208, as shown in FIG. 4. From a distance and at first glance, the combination of carrier cover 100 and pullover shirt 200 are intended to appear as a standard uniform shirt. The combination preserves the officer's tactical advantage gained by wearing concealed armor that is more comfortable to wear versus most outer carriers which do not match the shirts they are worn over.

To that end, the outer layer 130 is composed of a standard uniform shirt fabric of the appropriate color. The outer layer 130 can optionally include one or more of plain or pleated breast pockets 212, a false placket 214 with buttons 216, a shoulder yoke, shoulder epaulets, microphone tab 218, front and/or rear creases, MOLLE webbing 220, and any other items that may be found on a uniform shirt. The shirt fabric can be woven or knit fabrics or uniform shirt fabrics such as all wool or polyester, nylon, poly cotton, poly rayon, poly wool, waterproof barriers, or fire-retardant fabric combinations.

A liner 134 extends throughout a majority of the mantle 102. The liner 134 is composed of a knit or woven material, either polyester, nylon, or a combination of synthetic and natural fibers. The liner 134 may be wicking or non-wicking in performance. The liner 134 may be a stretch or non-stretch material. In the present embodiment, the central majority 226 of the liner 134 is a heavyweight polyester mesh, and strips 228, 230 that make up approximately 2-3 inches of the lower ends are nylon or polyester. The mesh and strips 228, 230 are attached to each other in whatever manner is appropriate for the materials.

Figure 5:
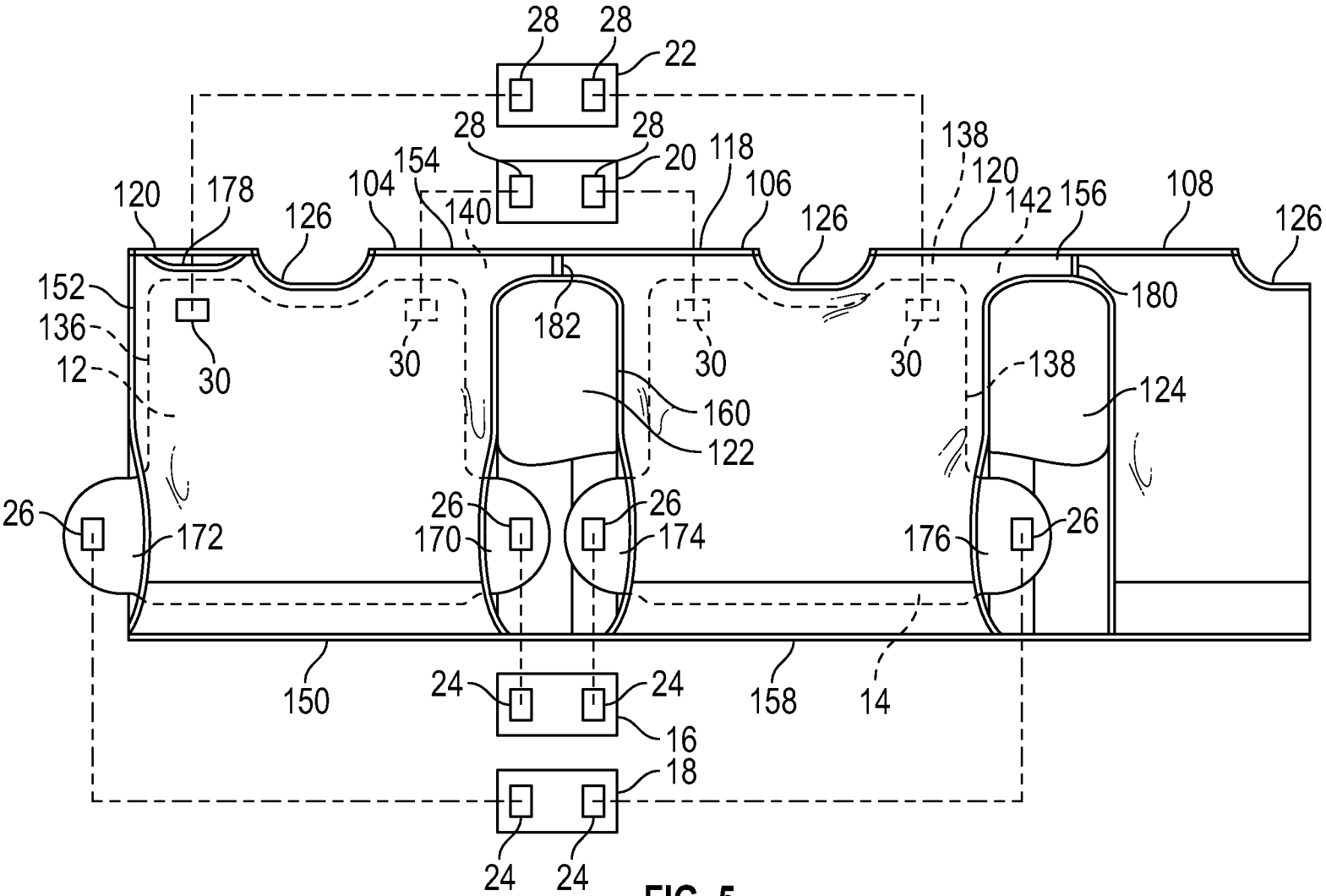
FIG. 5 is a view of the inside of the carrier cover laid out flat and with soft armor carriers installed.

The liner 134 is attached to the outer layer 130 at a number of places around the perimeter of the liner 134, as shown in FIG. 5. With these attachments, the outer layer 130 and liner 134 form a front armor pocket 136 in the front panel 104, a rear armor pocket 138 in the rear panel 106, a right tunnel 140 in the right shoulder 112 connecting the right side of the front armor pocket 136 and the right side of the rear armor pocket 138, and a left tunnel 142 extending from the left side of the rear panel 106 through the left shoulder 114. Several openings in the perimeter of the liner 134 provide access to these pockets and tunnels.

Moving clockwise around the perimeter of the liner 134 from the bottom left, the liner 134 is attached to the outer layer 130 as follows. The liner 134 is attached for the length of the front waist, as at 150. The liner 134 is unattached from the front waist to where the left arm opening 124 of the front panel 104 begins to form a left front armor opening 172. The liner 134 is attached from where the left arm opening 124 of the front panel 104 begins to the left shoulder 120, as at 152. The liner 134 is unattached across the left shoulder 120 of the front panel 104 to the neck opening 126 of the front panel 104 to form a front panel left tunnel opening 178. The liner 134 is attached around the neck opening 126 of the front panel 104, through the right shoulder 118, around the neck opening 126 of the rear panel 106, and through the left shoulder 120, as at 154. The liner 134 is unattached across the left shoulder 120 to form a front overlay left tunnel opening 180. The liner 134 is attached through the left shoulder 120 and around to near the bottom of the left arm opening 124 of the rear panel 106, as at 156. The liner 134 is unattached from near the bottom of the left arm opening 124 of the rear panel 106 to the rear waist to form a left rear armor opening 176. The liner 134 is attached for the length of the rear waist, as at 158. The liner 134 is unattached from the rear waist to near the bottom of the right arm opening 122 of the rear panel 106 to form a right rear armor opening 174. The liner 134 is attached near the bottom of the right arm opening 122 of the rear panel 106, around to near the bottom of the right arm opening 122 of the front panel 104, as at 160. The liner 134 is unattached from near the bottom of the right arm opening 122 of the front panel 104 to the front waist to form a right front armor opening 170.

A right tunnel opening 182 extends laterally across the right shoulder 118 to provide access to the right tunnel 140.

As shown in FIG. 5, the front armor openings 170, 172 provide access to the front armor pocket 136 and the rear armor opening 174, 176 provide access to the rear armor pocket 138 for installing and removing the armor panel carriers 12, 14.

Figure 6:
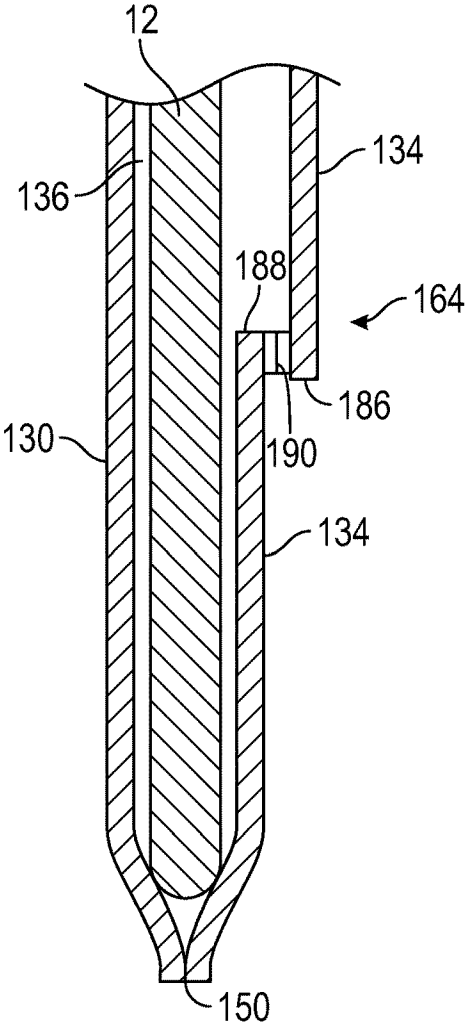
FIG. 6 is a side cross-sectional view of a bottom opening for installing the soft armor carrier.

Optionally, and in addition to the armor openings 170, 172, 174, 176, the present invention contemplates that there may be lateral openings 164 in the pockets 136, 138 for inserting the armor panel carriers 12, 14. Either the front, the rear, or both the front and rear can have a lateral opening 164. In one configuration, the waist attachments 150, 158 are zippers, hook and loop fasteners, or other openable fasteners that facilitate inserting the armor panel carriers 12, 14 into the pockets 136, 138 from the bottom. In another configuration, the lateral opening 164 is formed by overlapping edges 186, 188 of the liner 134, as in FIG. 6. The edges 186, 188 are closed by a zipper, a hook and loop fastener, or other openable fastener 190.

The armor openings 170, 172, 174, 176 allow the use of the soft armor waist straps 16, 18 that are supplied with the soft armor for individual adjustment. Each waist strap 16, 18 extends around the wearer's side and attaches by hook and loop fastener patches 26 that mate to corresponding hook and loop fastener patches 24 on the soft armor panel carrier 12, 14.

The tunnels 140, 142 at each shoulder allow fastening of the front and rear armor panel carriers 12, 14 using the soft armor shoulder straps 20, 22 supplied with soft armor. The shoulder straps 20, 22 extend through the tunnels 140, 142 and use hook and loop fastener patches 30 to attach to corresponding hook and loop fastener patches 28 on the soft armor panel carriers 12, 14. The right tunnel opening 182 provides access to the right tunnel 140. When being worn, the front panel left tunnel opening 178 and the front overlay left tunnel opening 180 align and provide access to the left tunnel 142 and to the front armor pocket 136 for the left shoulder strap 22.

The side panels 110, 112 preferably allow for improved ventilation, better fit, and freer motion, and are preferably composed substantially of a stretch fabric. The amount of stretch is significantly more than what is considered a non-stretch material. The present invention considers that a material that increases in length by at least 8% when under tension is a stretch material. The side panels 110, 112 cover those portions of the soft armor panel carriers 12, 14 and soft armor straps 16, 18 outside of the pockets 136, 138, thereby facilitating the illusion of a standard uniform shirt.

Hard armor plates are well-known in the industry. They are rigid plates, typically made of coated steel, ceramic, polyethylene, or carbon composites. Front hard armor plates are made to cover the front torso, rear hard armor plates are made to cover the rear torso, and side hard armor plates are made to cover the side rib cage. The front and rear hard armor plates are generally contoured to fit the front and rear torso of a wearer and come in a range of sizes, typically from 8"×10" to 11"×14". They are also found in a range of thickness, ranging from ¼" to 1¼". Various combinations of materials and thicknesses provide for a wide range of available protection levels. Side hard armor plates typically have a single curve to hug the body. They come in a range of sizes from 6"×6" to 8"×10" and in thicknesses from ½" to 1¼".

Optionally, the present invention incorporates a front pouch 302 and/or a rear pouch 304 into the carrier cover 100. The front pouch 302 is inside the front armor pocket 136 with access from the outside of the carrier cover 100 to facilitate quick installation of a front hard armor plate 40. The rear pouch 304 is inside the rear armor pocket 138 with access from the outside of the carrier cover 100 to facilitate quick installation of a rear armor plate 42.

The present invention also contemplates the optional incorporation of side pouches 306, 308 in the side panels 110, 112 of the carrier cover 100 with access from either inside or the outside of the carrier cover 100 for installation of side armor plates 44, 46.

Figure 7:
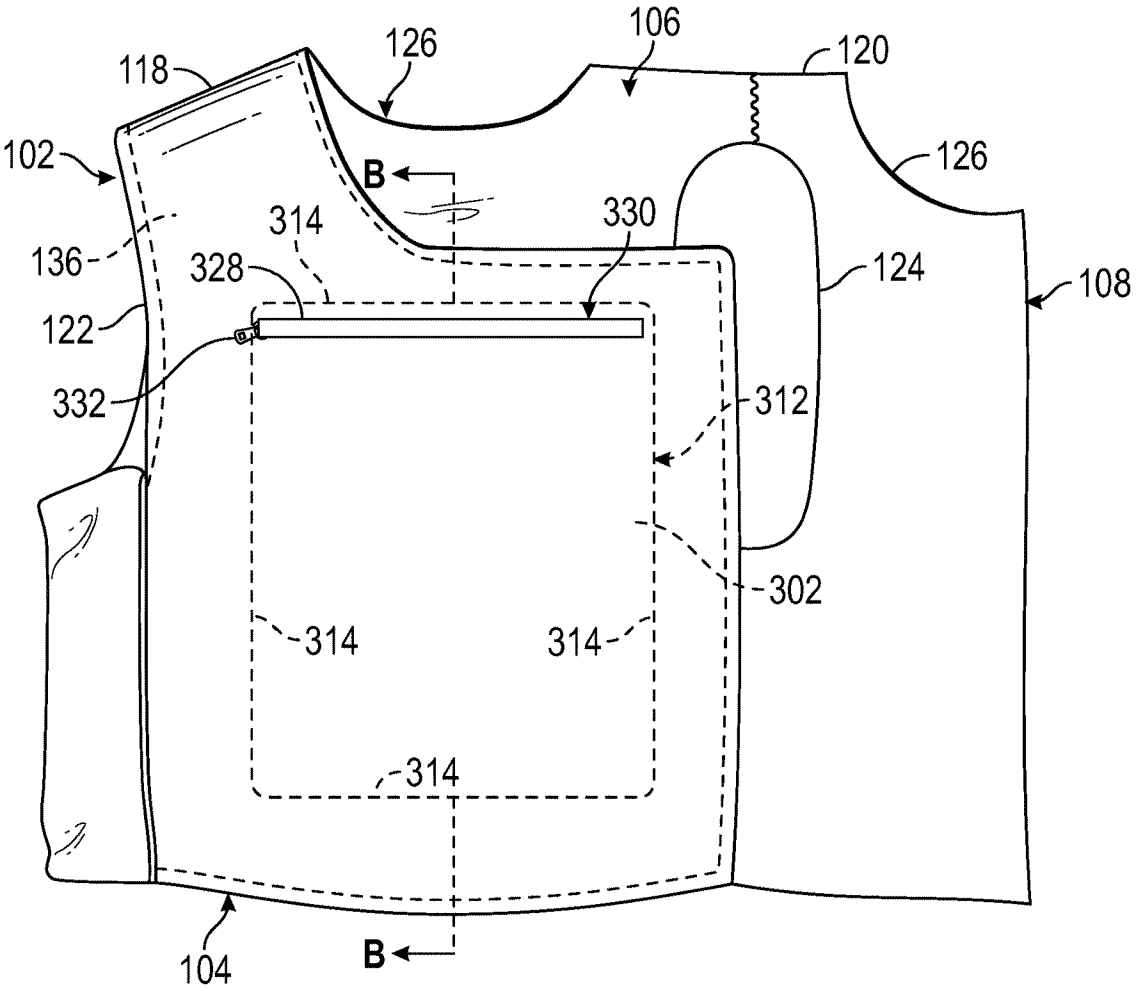
FIG. 7 is a front view of a carrier cover showing the front armor pocket and the single sheet front armor pouch in phantom with a lateral opening.
Figure 8:
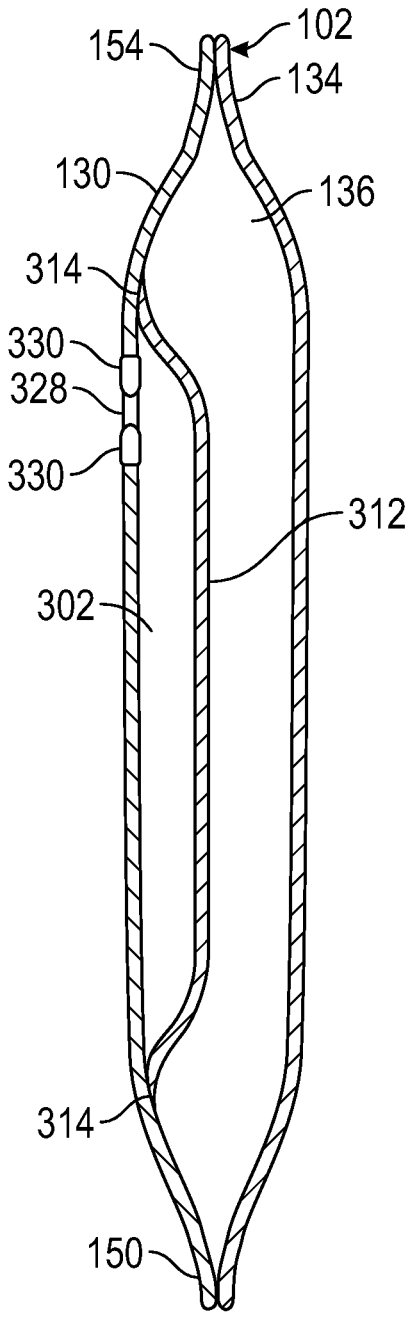
FIG. 8 is a side cross-sectional view taken at B-B of FIG. 7 of the front armor pocket and the single sheet embodiment of the front armor pouch with the lateral opening.

One configuration of the front pouch 302 is shown in FIGS. 7 and 8. The front pouch 302 is attached to the inside of the outer layer 130 within the pocket 136. The front pouch 302 is a single fabric sheet 312 that is attached to the outer layer 130 around the sheet perimeter 314. The single sheet 312 is attached only to the outer layer 130 so it does not interfere with installation of the front armor carrier 12 into the front pocket 136. In reference to the incorporated pouch, the outer layer 130 is intended to include any interlining 132 that may be attached to the outer layer 130.

Figure 9:
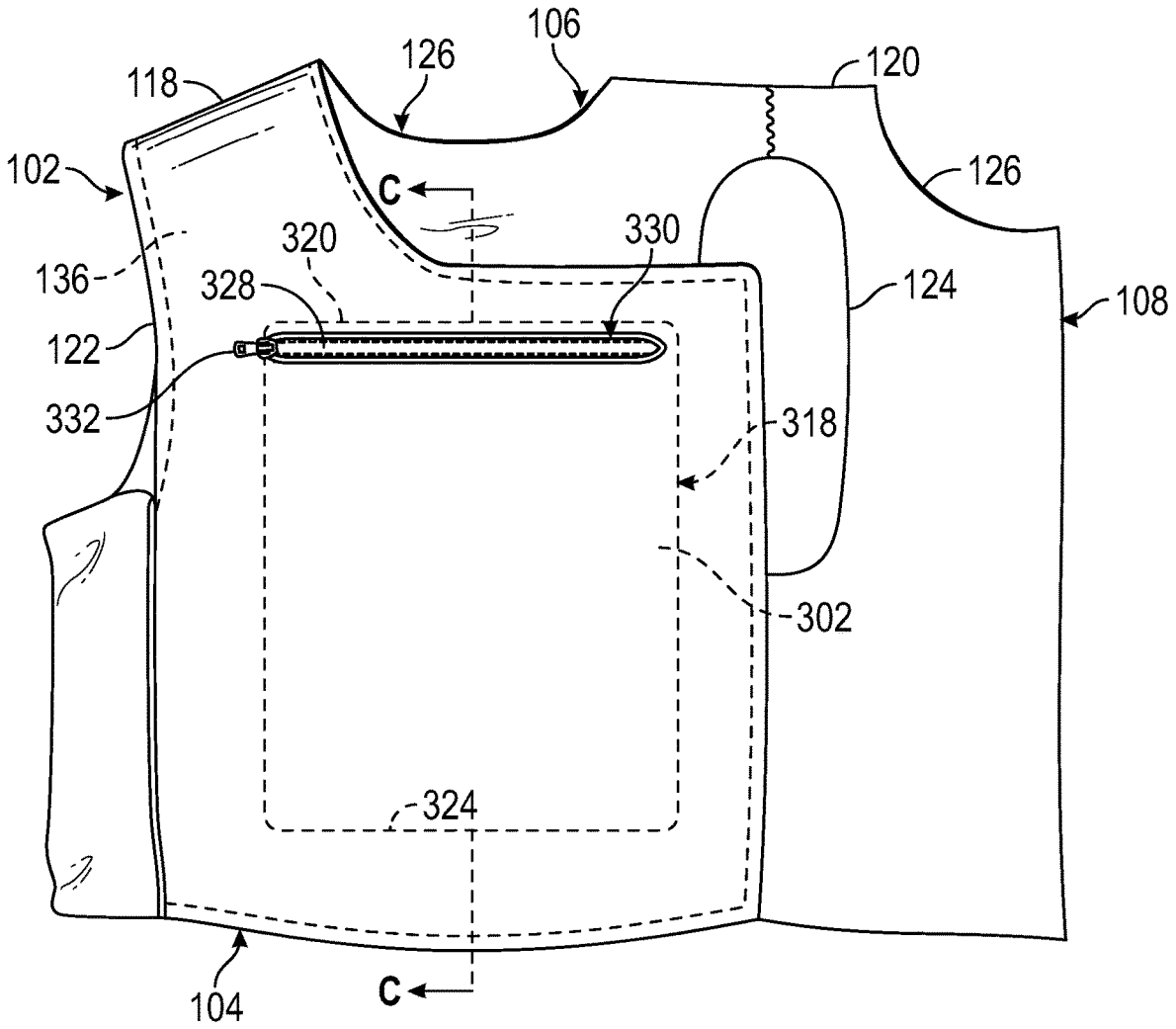
FIG. 9 is a front view of a carrier cover showing the front armor pocket and the first configuration of the bag front armor pouch in phantom with a lateral opening.
Figure 10:
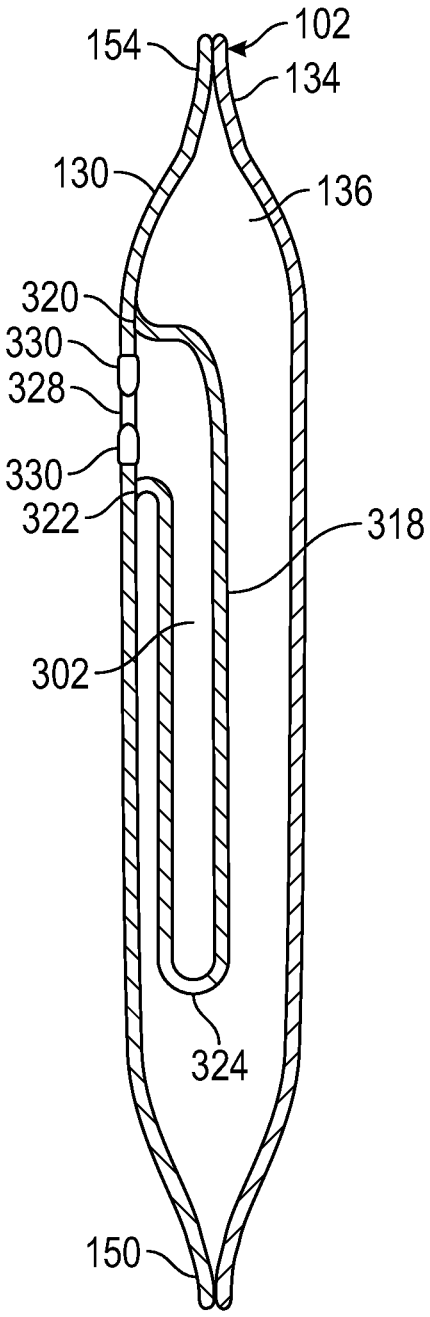
FIG. 10 is a side cross-sectional view taken at C-C of FIG. 9 of the front armor pocket and the bag front armor pouch with the lateral opening.

In another configuration, shown in FIGS. 9 and 10, the front pouch 302 is a bag 318. The upper edges 320, 322 of the bag 318 are attached to the outer layer 130 so that the bag 318 hangs freely within the front pocket 136. Optionally, the bottom end 324 of the bag 318 is tacked to the outer layer 130 so that it does not fold or otherwise crease in a way that interferes with installation of the front armor carrier 12 into the front pocket 136 or prevents easy installation of the front armor plate 40, as described below. As with the single sheet 312, the bag 318 is attached only to the outer layer 130 so it does not interfere with installation of the front armor carrier 12.

Figure 11:
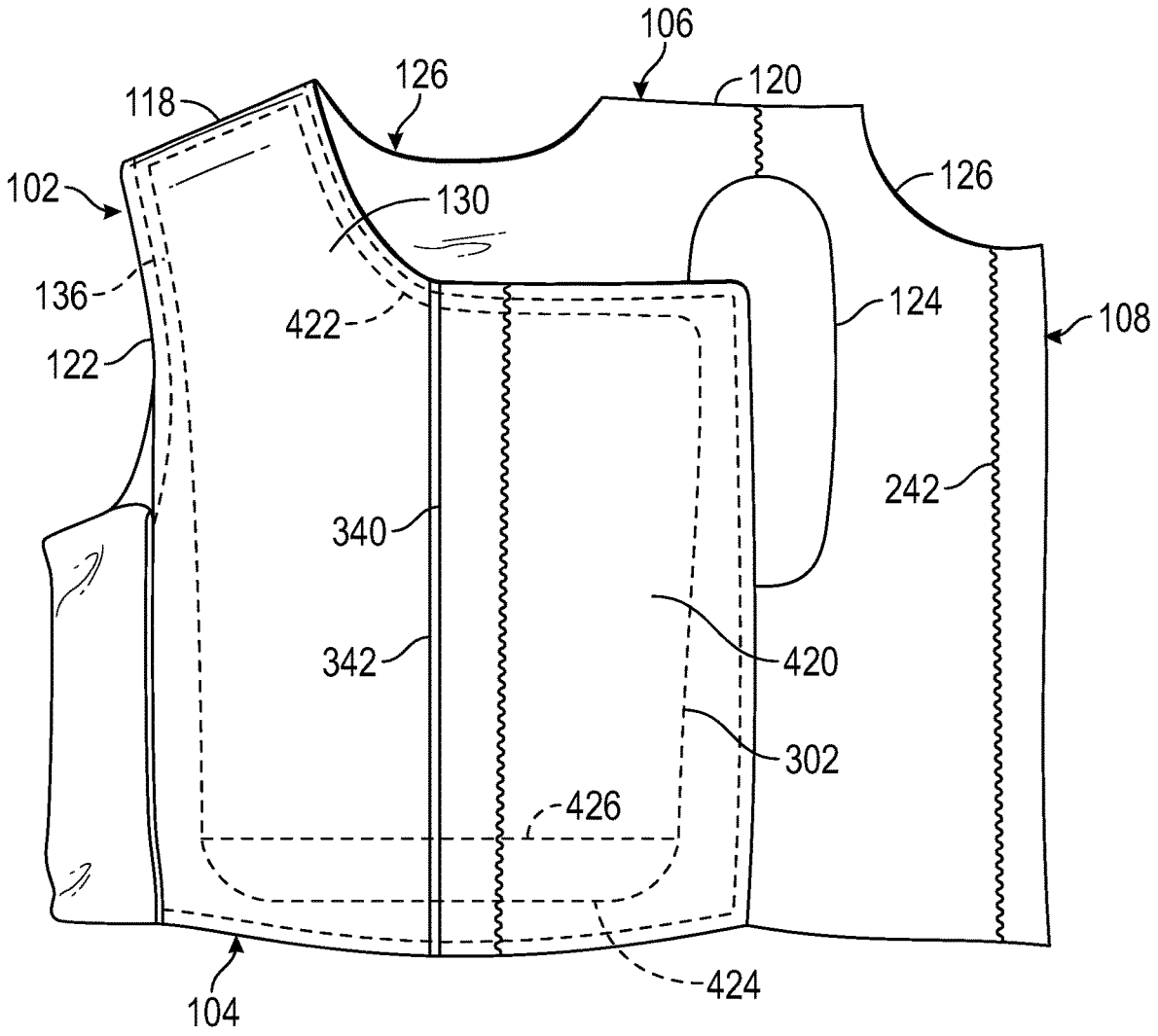
FIG. 11 is a front view of a carrier cover showing the front armor pocket and the second configuration of the bag front armor pouch in phantom with a vertical opening.

In another configuration, shown in FIG. 11, the front pouch 302 is a bag 420 that is closed at the top. The upper end 422 of the bag 420 is attached at the shoulders 118, 120 and neck opening 126 so that the bag 420 hangs within the front pocket 136. The bottom end 424 of the bag 420 is sewn to the outer layer 130, as at 426, so that the bag 420 does not fold or otherwise crease in a way that interferes with installation of the front armor carrier 12 into the front pocket 136 or prevents easy installation of the front armor plate 40, as described below.

In one configuration, shown in FIGS. 7-10, the top end of the front pouch 302 is accessed via a front pouch lateral opening 328 in the outer layer 130 that extends across the front panel 104 high on the chest. The front pouch lateral opening 328 is closed by an openable front pouch lateral fastener 330, such as a zipper 332, hook and loop fastener, or snaps.

If the pouch embodiment of FIG. 11 has a lateral front opening like that of FIG. 9, the bag 420 has a lateral slit in the side at the location of the front pouch lateral opening 328. The edges of the slit are sewn to the outer layer 130 at the front pouch lateral opening 328 and the front pouch lateral fastener 330.

Figure 12:
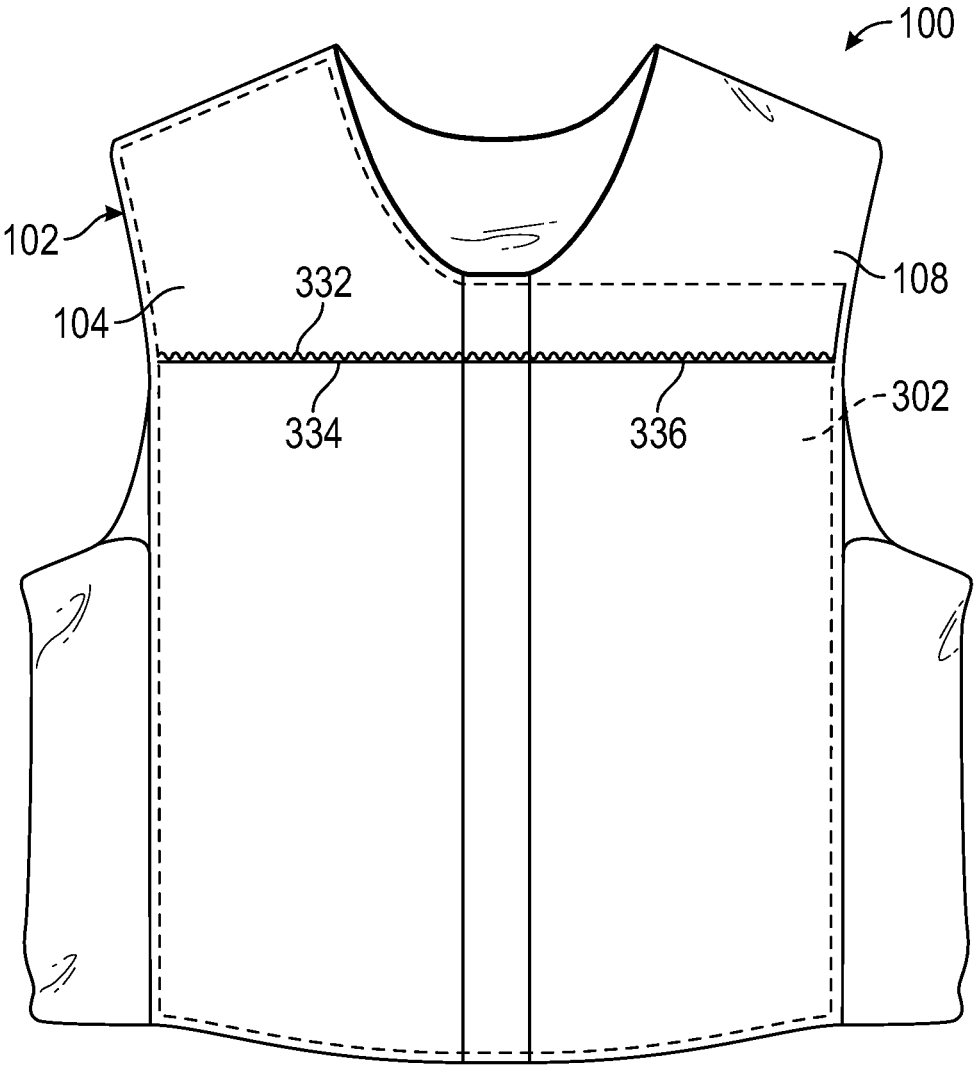
FIG. 12 is a front view of a carrier cover showing the front armor pouch in phantom with a lateral opening.
Figure 13:
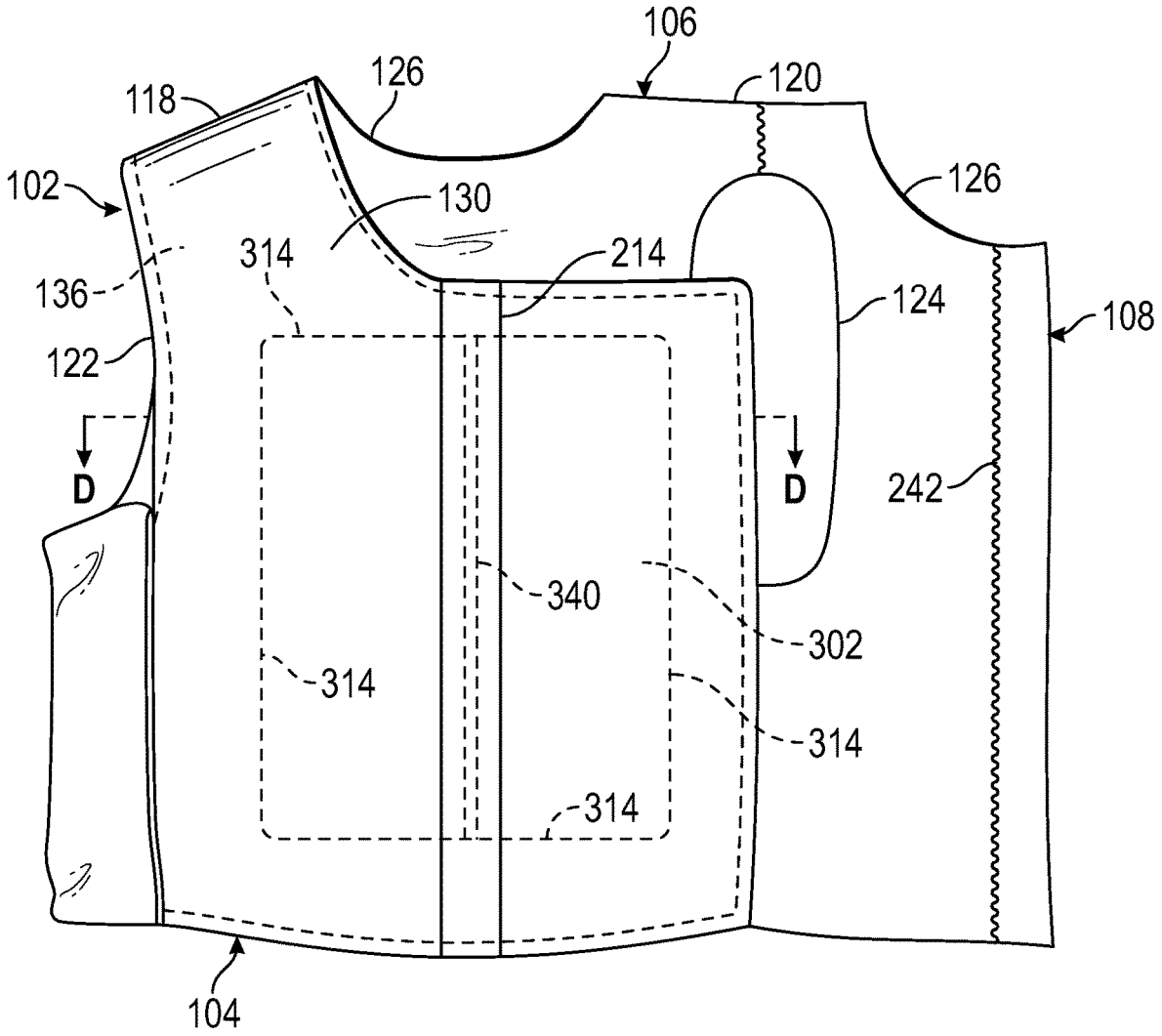
FIG. 13 is a front view of a carrier cover showing the front armor pocket and the single sheet front armor pouch in phantom with a vertical opening.
Figure 14:
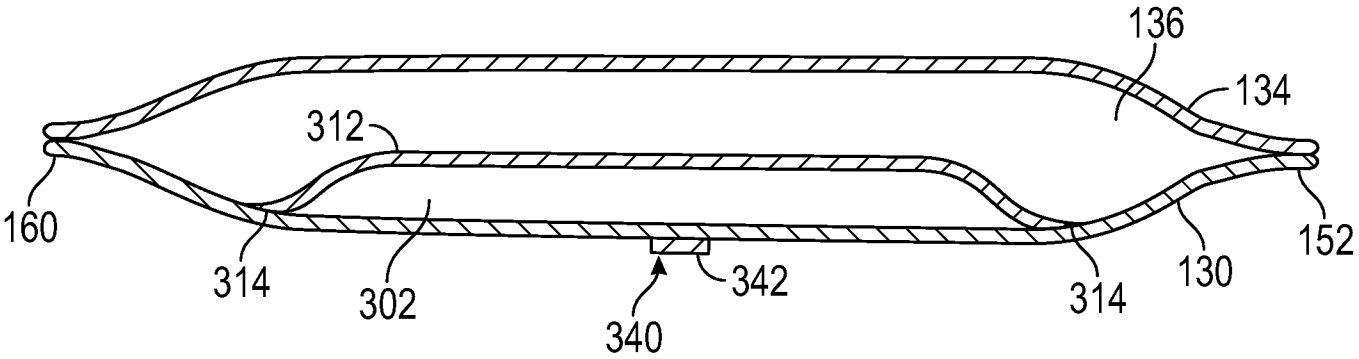
FIG. 14 is a top cross-sectional view taken at D-D of FIG. 13 of the front armor pocket and the single sheet front armor pouch with the vertical opening.

Optionally, the front pouch lateral zipper 332 is an invisible zipper hidden in a seam 334. In order for the seam 334 to appear to extend across the entire front of the cover 100 when closed, the front overlay 108 has a corresponding faux seam 336 that is aligned with the front pouch lateral zipper seam 334, as in FIG. 12.

In another embodiment, the front pouch 302 is accessed via a front pouch vertical opening 340, as shown in FIGS. 11-15. The front pouch vertical opening 340 in the outer layer 130 extends vertically along the front panel 104 from at or just below the neck opening 126 to or just above the waist, preferably at or near the center of the front panel 104. The front pouch vertical opening 340 is closed by an openable front pouch vertical fastener 342, such as a zipper 344, hook and loop fastener, or snaps. Optionally, the front pouch vertical fastener 342 is a style of zipper called a hidden zipper. Further, the front pouch vertical fastener 342 can be hidden by a false placket 214, as described in more detail below.

In the pouch embodiment of FIG. 11, in order to access the front pouch 302, the bag 420 has a vertical slit in the side at the location of the front pouch vertical opening 340. The edges of the slit are sewn to the outer layer 130 at the front pouch vertical opening 340 and the front pouch vertical fastener 342.

Figure 15:
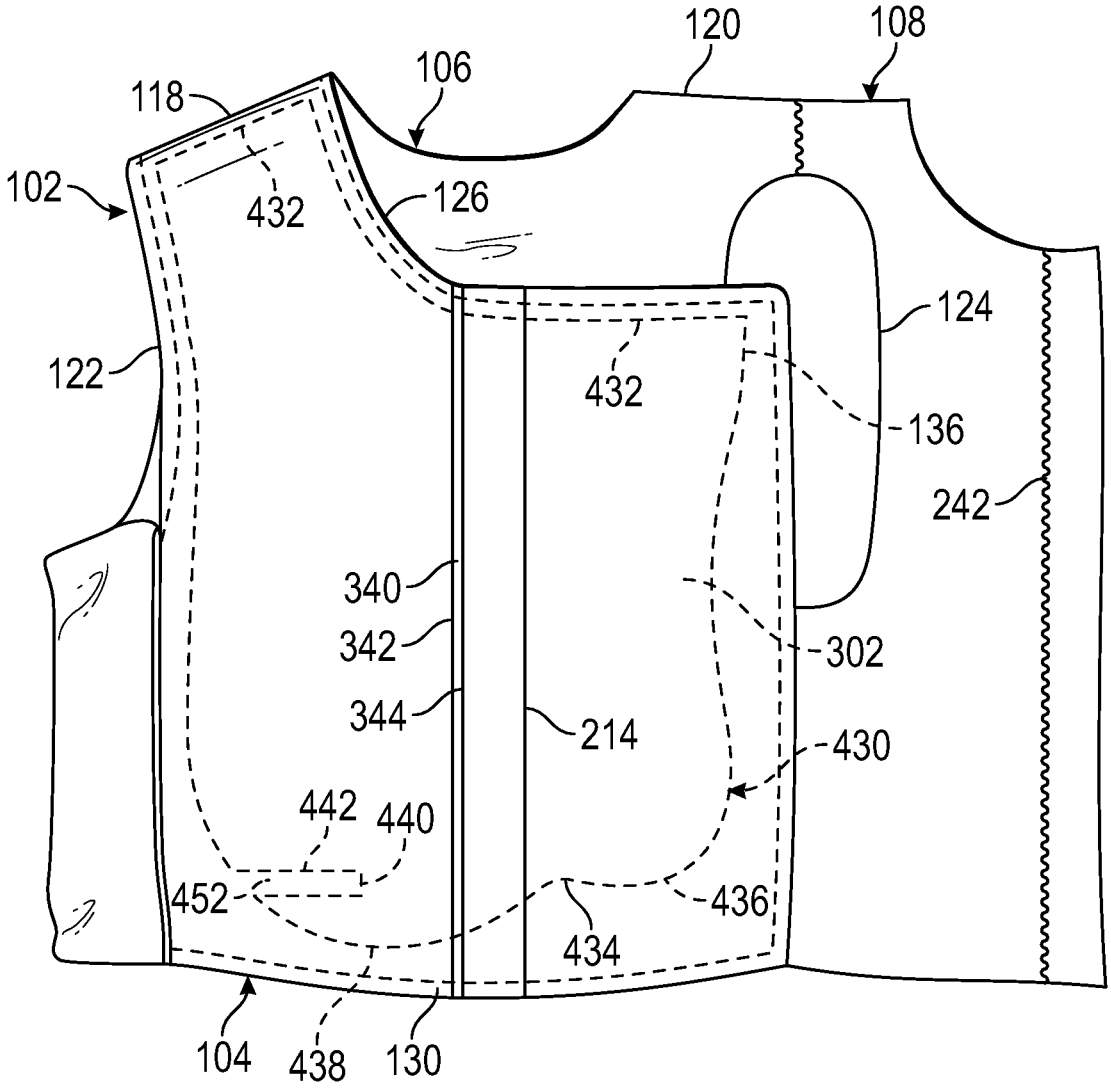
FIG. 15 is a front view of a carrier cover showing the front armor pocket and the shaped bag front armor pouch in phantom with a vertical opening.

For some front armor plates, forming the front pouch 302 in the particular shape shown in FIG. 15 makes installing the front armor plate 40 easier. The front pouch 302 is a bag 430 that is closed at the top. The right upper end 432 of the bag 430 is attached at the right shoulder 118, neck opening 126, and upper left of the front panel 104 so that the bag 430 hangs within the front pocket 136. The bottom 434 of the bag 430 has a side lobe 436 that distends the lower side of the bag 430 to the left and a bottom lobe 438 that distends the bottom 434 of the bag 430 adjacent to the side opposite the side lobe 436 downwardly. A plate support 440 extends horizontally into the bag 430 from the side of the bag 430 opposite the side lobe 436 and is aligned with the bottom 434 of the side lobe 436. The plate support 440 and the bottom 434 of the side lobe 436 provide a floor to support the armor plate 40, as described below.

The plate support 440 can be a single stitched line or can include other elements for strength. In FIG. 15, the plate support 440 includes a length of ribbon for strength and appears as a notch 452.

The notch 452 and, optionally, the bottom 434 of the bag 430 are sewn to the outer layer 130 so that the bag 430 does not fold or otherwise crease in a way that prevents easy installation of the front armor plate 40. Also, sewing the notch 452 to the outer layer 130 provides support for the armor plate 40, as described below.

FIG. 15 shows the side lobe 436 on the left side of the bag 430 and the bottom lobe 438 and notch 452 on the right side. The present invention contemplates that the mirror image can also be implemented.

The pouch shape of FIG. 15 can also be adapted to the single sheet pouch of FIGS. 7 and 8 and the bag pouch of FIGS. 9 and 10.

Figure 16:
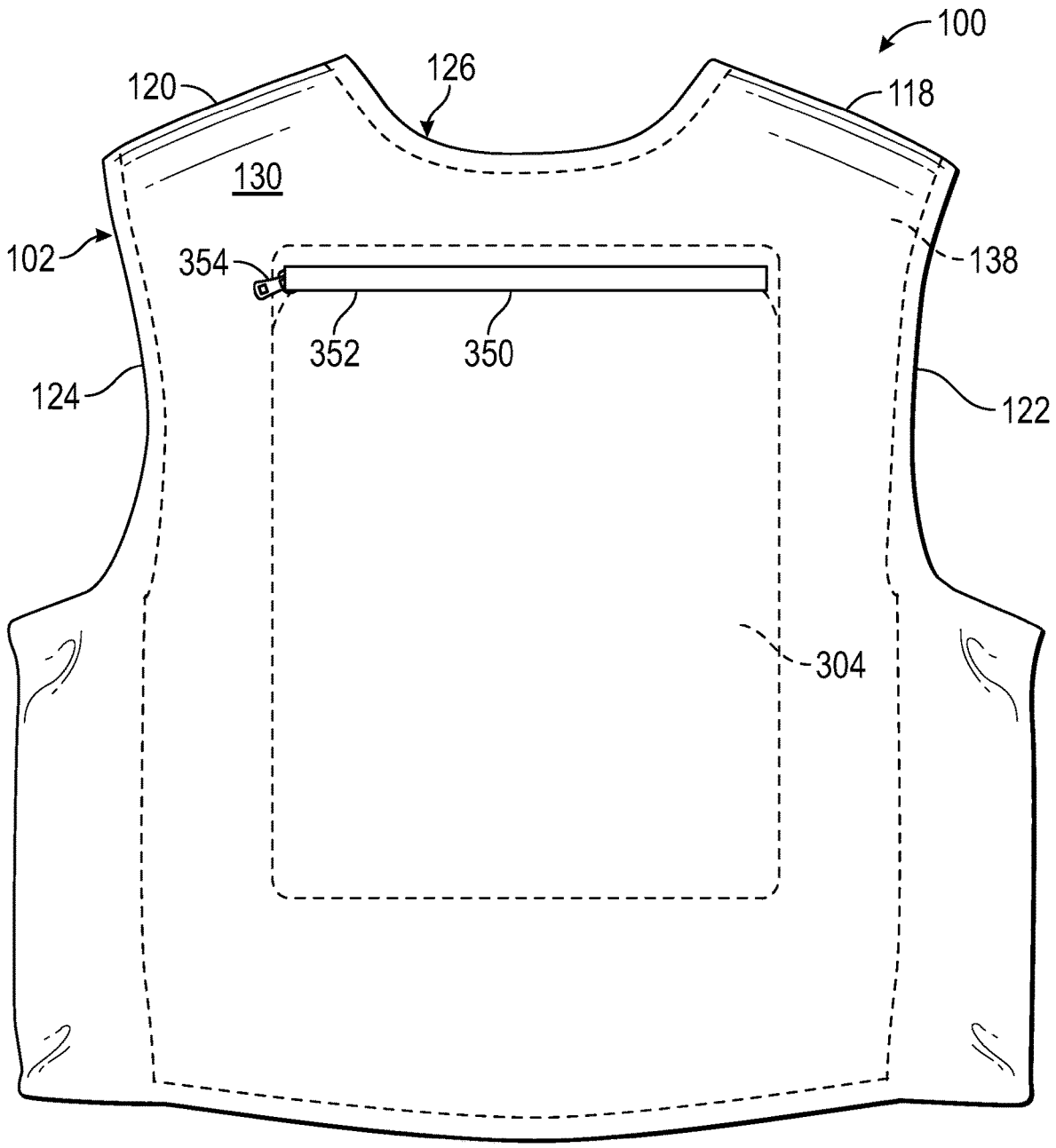
FIG. 16 is a rear view of a carrier cover showing the rear armor pocket and the single sheet rear armor pouch in phantom.
Figure 17:
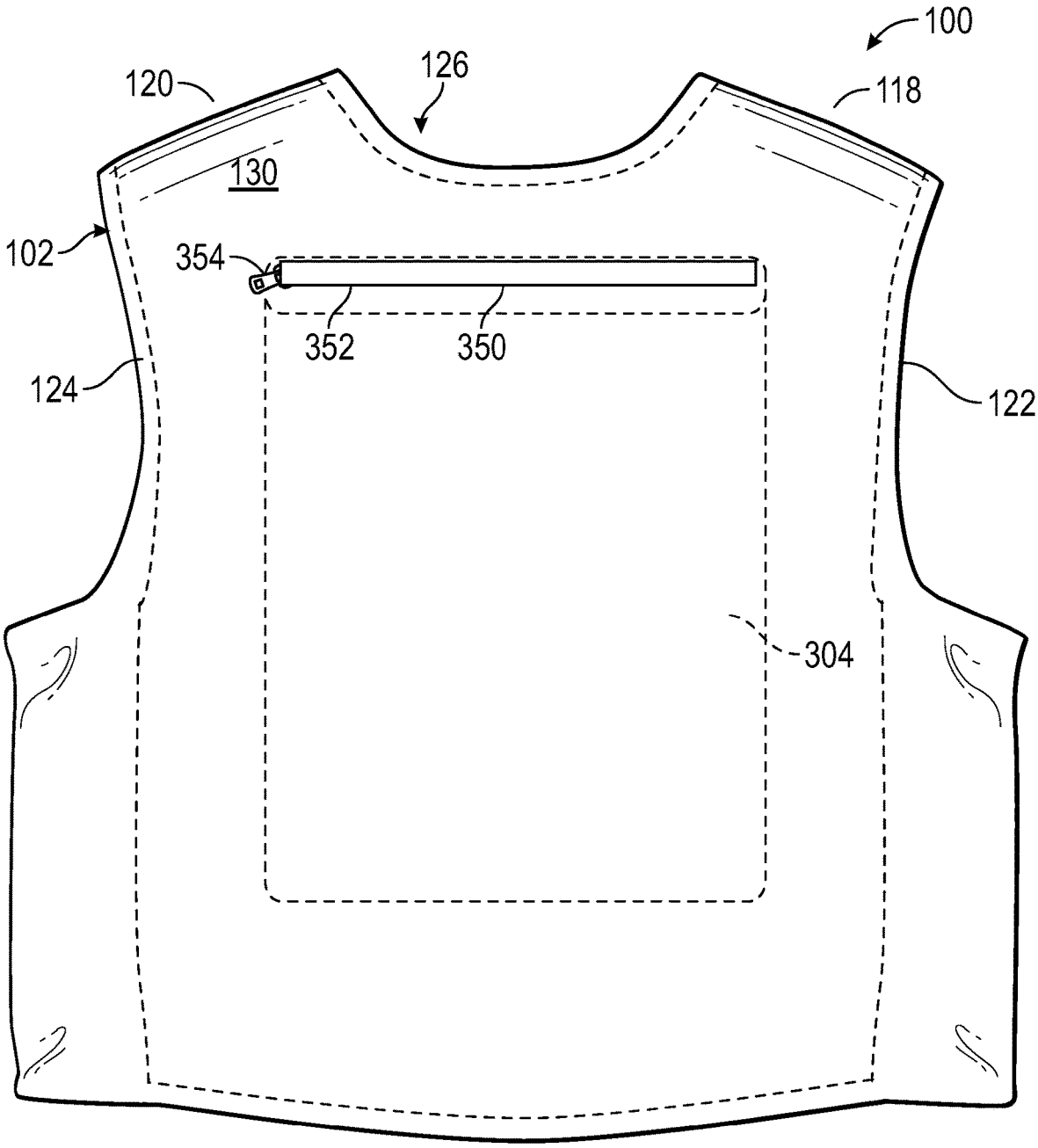
FIG. 17 is a rear view of a carrier cover showing the rear armor pocket and the first configuration of the bag rear armor pouch in phantom.
Figure 18:
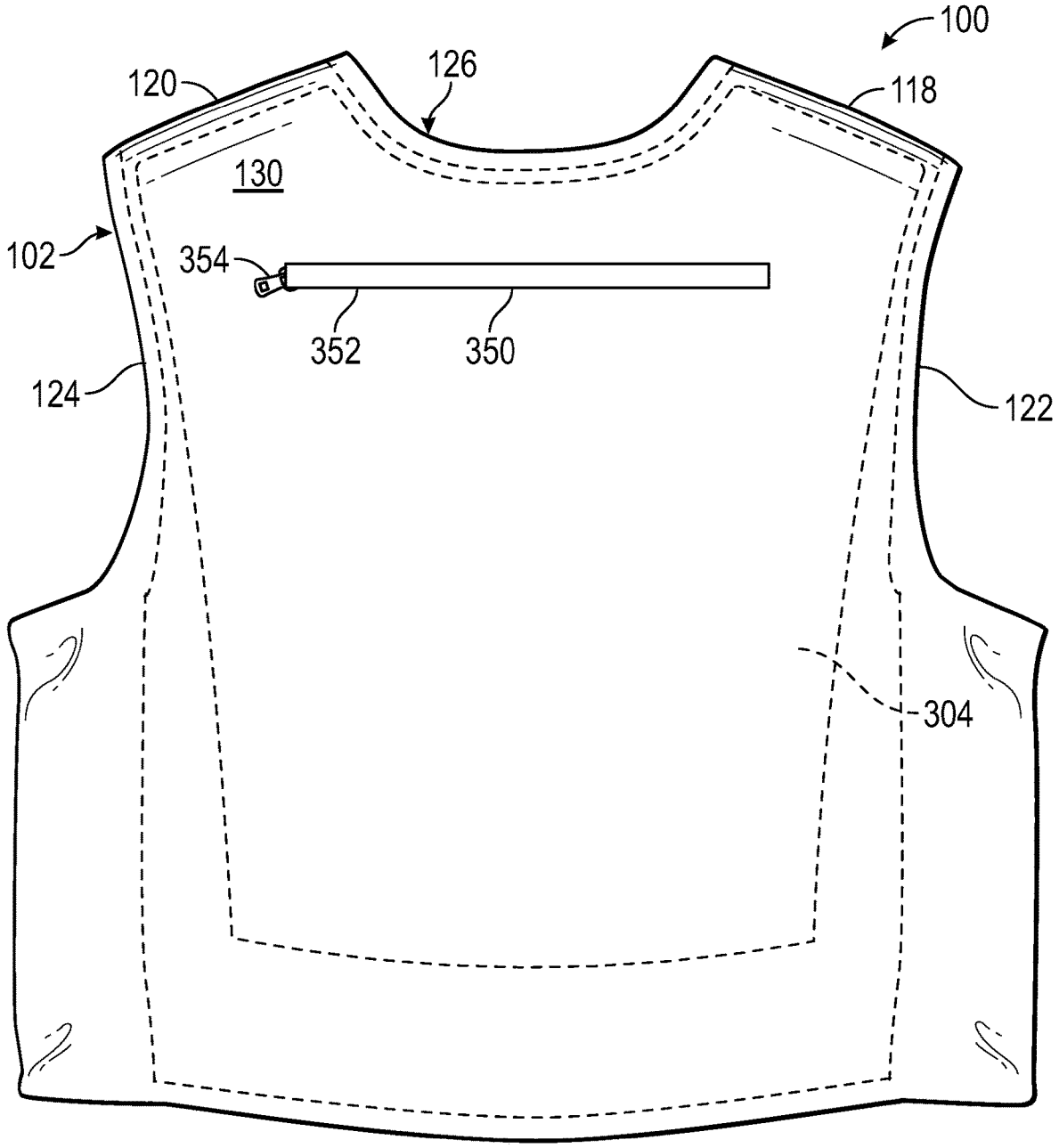
FIG. 18 is a rear view of a carrier cover showing the rear armor pocket and the second configuration of the bag rear armor pouch in phantom.

The rear pouch 304 is shown in FIGS. 16-18. The rear pouch 304 can take either the single sheet form shown in FIG. 16, the bag form shown in FIG. 17, or the bag form shown in FIG. 18, all of which are described above with reference to the front pouch 302.

A rear pouch opening 350 in the outer layer 130 extends across the rear panel 106 high on the back, just below the neck opening 126. The rear pouch opening 350 is closed by an openable rear pouch fastener 352, such as a zipper 354, a hook and loop fastener, or snaps. Optionally, the rear pouch zipper 354 is an invisible zipper hidden in a seam 356.

In the configuration of FIG. 18, in order to access the rear pouch 304, the bag has a lateral slit in the side at the location of the rear pouch opening 350. The edges of the slit are sewn to the outer layer 130 at the rear pouch opening 350 and the rear pouch fastener 352.

The sheet/bag of the pouches 302, 304 are composed of a fabric material that is robust enough to handle the weight and abrasion from the hard armor plates 40, 42. Materials include coated nylon and nylon/polyester meshes.

Optionally, the lower portion of the pouches 302, 304, for example, the lower third, is reinforced, as at 346, by an additional layer of material, a thicker material, a fiber-reinforced material, or a coating. The reinforcement 346 helps prevent tears and other wear that may be caused by dropping the heavy plate 40, 42 into the pouches 302, 304.

In one configuration, the pouches 302, 304 are intended for use with a single size and thickness of armor plates 40, 42, and are sized accordingly so that the armor plates 40, 42 do not slide around inside the pouches 302, 304.

Figure 19:
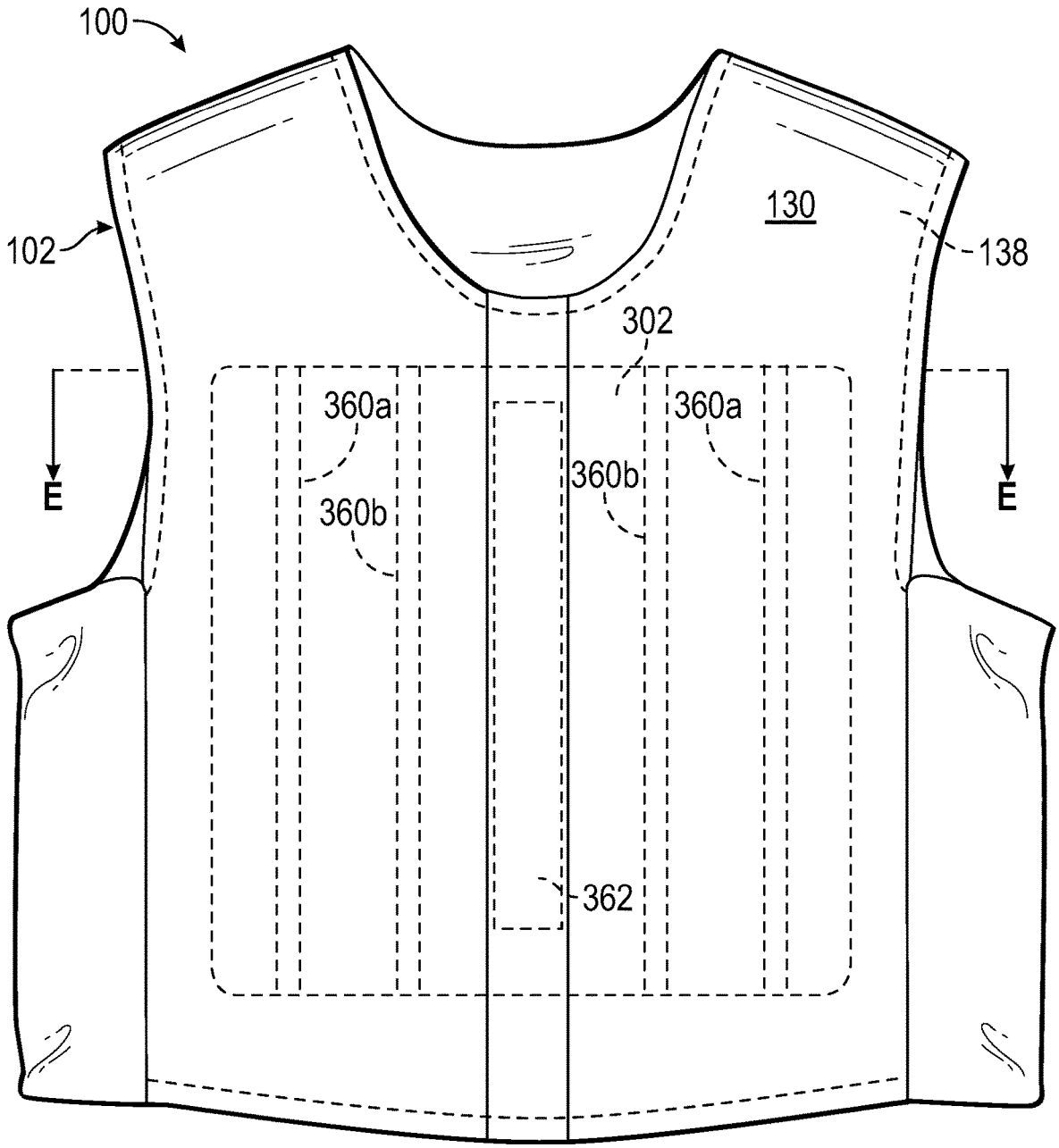
FIG. 19 is a front view of a carrier cover showing the front armor pocket and the front armor pouch with optional sizing strips in phantom and an optional thickness loop fastener in phantom.
Figure 20:
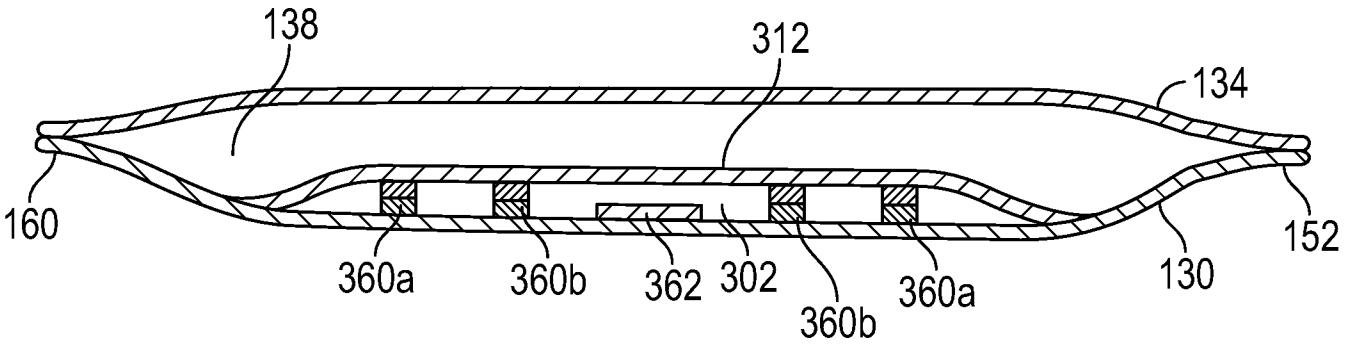
FIG. 20 is a top cross-sectional view taken at E-E of FIG. 19 showing the front armor pocket and the front armor pouch with the optional sizing strips and the optional thickness loop fastener.

In another configuration, the pouches 302, 304 are intended for use with a variety of armor plates 40, 42 having different widths. Optionally, in order to prevent the armor plates 40, 42 from sliding from side to side, the pouches 302, 304 have internal vertical sizing strips 360*a*, 360*b* (collectively, 360), as shown in FIGS. 19 and 20 with the single sheet embodiment of the front pouch 302. The sizing strips 360 come in opposed pairs 360*a*, 360*b* so that the armor plate 40, 42 is kept centered on the torso when installed in the pouch 302, 304. The sizing strips 360 are strips of detachable fasteners, preferably hook and loop fasteners. Other detachable fasteners may be used, such as lines of snaps.

In another embodiment, the pouches 302, 304 are intended for use with a variety of armor plates 40, 42 having different thicknesses. The pouches 302, 304 are sized so that the thickest armor plate 40, 42 fits snuggly. To prevent the thinner armor plates 40, 42 from sliding around, the pouches 302, 304 each have an internal strip of loop fastener 362, as shown in FIGS. 19 and 20, that mates to a corresponding hook fastener on the armor plate 40, 42.

Optionally, each pouch 302, 304 can accept more than one armor plate 40, 42 at the same time in the event the wearer wants more protection than is available from a single armor plate 40, 42.

Optionally, there is a right pouch 306 in the right side panel 110 and a left pouch 308 in the left side panel 112 for side hard armor plates 44, 46, as shown in FIGS. 21-24. The present invention contemplates several configurations for the side pouches 306, 308.

Figure 21:
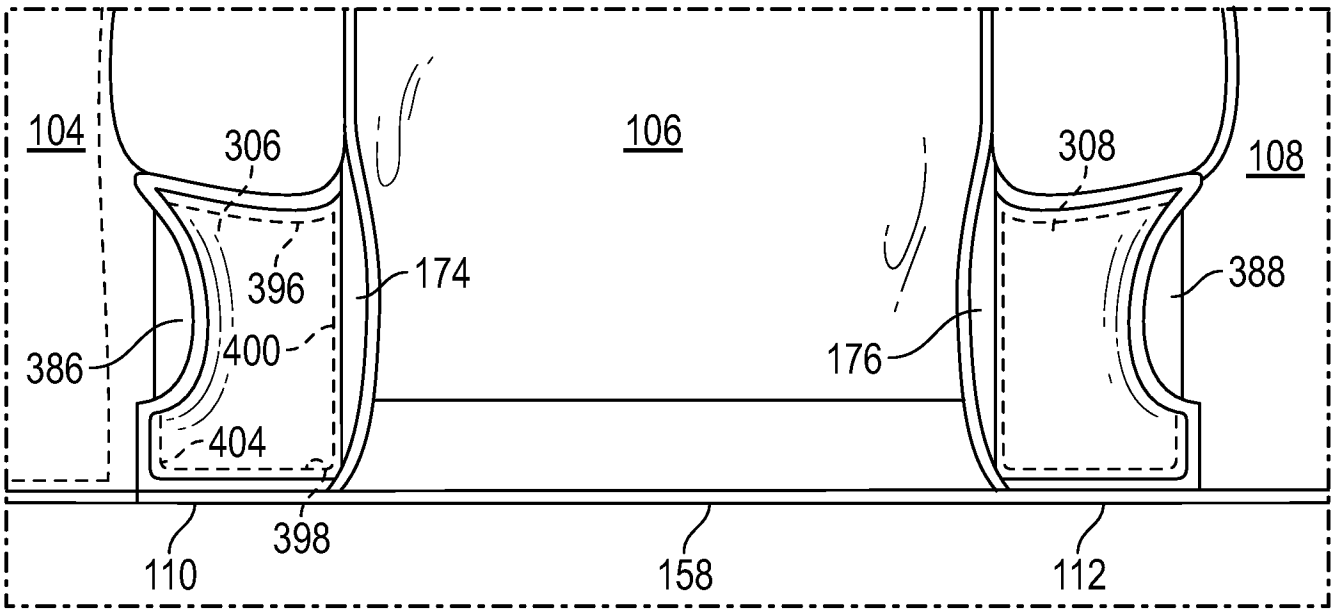
FIG. 21 is a view of the bottom rear of a carrier cover showing a first configuration of the side armor pouches in phantom with a vertical opening.

One configuration of the side pouches 306, 308 is shown in FIG. 21. Referring to the right pouch 306 (the left pouch 308 is the mirror image), the side panel 110 has an outer layer 392 and an inner layer 394 that are attached at the top edge 396, bottom edge 398, rear edge 400, and the lower portion 404 of the front edge, forming the pouch 306 and a vertical pouch opening 386 through which the pouch 306 is accessed. The lower portion 404 extends upwardly far enough so that the side armor plate 44 does not fall out after being installed. Consequently, the opening 386 typically does not need an openable fastener. The outer layer 392 and inner layer 394 are preferably composed of a stretch fabric, which provides some pressure to retain the side armor plate 44 in the pouch 306. The present invention does contemplate, however, the opening 386 may have an openable fastener.

Optionally, the lower portion of the pouch 306, for example, the lowest 20%, is reinforced, as at 406, by a thicker material, a fiber-reinforced material, or a coating. The reinforcement 406 helps prevent tears and other wear that may be caused by the heavy plate 44.

Optionally, the front portion of the pouch 306, for example, the front 40%, is reinforced, as at 408, by a thicker material, a fiber-reinforced material, or a coating. The reinforcement 408 helps prevent tears and other wear that may be caused by installing and removing the heavy plate 44.

Figure 24:
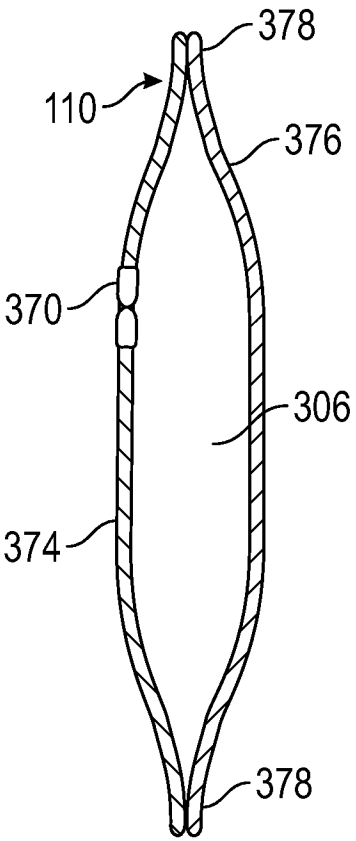
FIG. 24 is a front cross-sectional view taken at F-F of FIG. 22 of the right side armor pouch.
Figure 23:
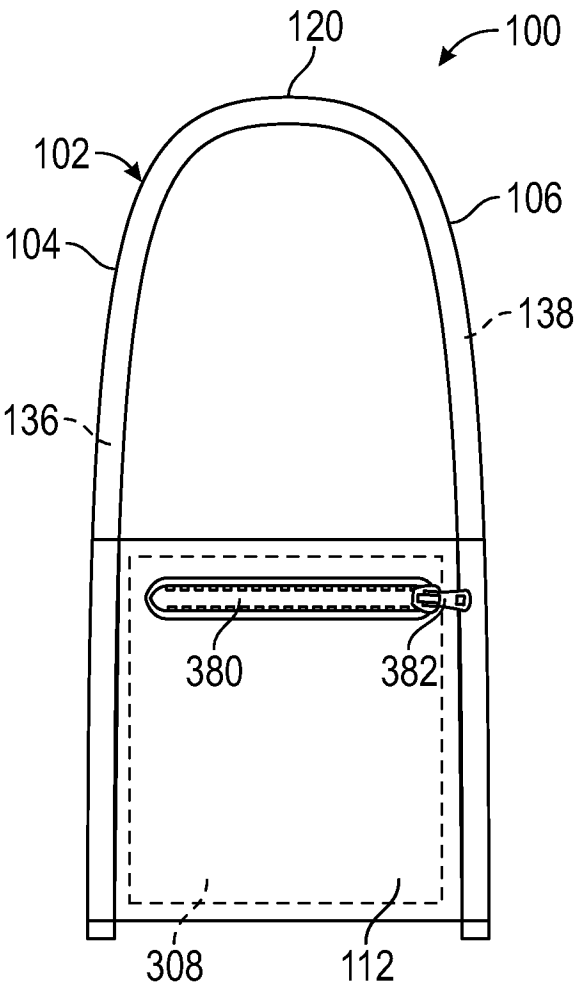
FIG. 23 is a left side view of a carrier cover showing the FIG. 22 configuration of the left side armor pouch in phantom with an open lateral opening.
Figure 22:
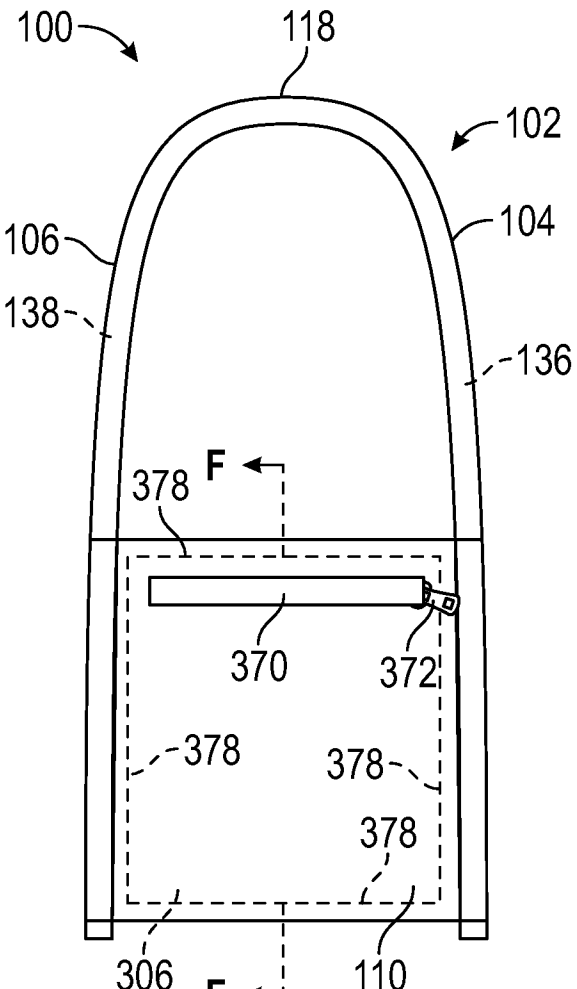
FIG. 22 is a right side view of a carrier cover showing a first configuration of the right side armor pouch in phantom with a closed lateral opening.

Another configuration of the side pouches 306, 308 is shown in FIGS. 22-24. As shown in FIG. 24, the side panel 110 has an outer layer 374 and an inner layer 376 that are attached around the edges 378, forming the pouch 306. The top end of the right pouch 306 is accessed via a lateral opening 370 in the outer layer 374 or between the outer layer 374 and inner layer 376 that extends across the right side panel 110. The lateral opening 370 is optionally closed by an openable fastener 372, such as a zipper 380, hook and loop fastener or snaps.

The carrier cover 100 is used in two steps. First, the armor panel carriers 12, 14 are installed into the pockets 136, 138, as in FIG. 5. The right shoulder strap 20 is extended through the right tunnel 140, optionally using the right tunnel opening 182, and the hoop and loop patches 30 are attached to the corresponding hoop and loop patches 28 on the right side of the front and rear armor panel carriers 12, 14. The left shoulder strap 22 is extended through the left tunnel 142 with the hoop and loop patch 30 on one end attached to the hoop and loop patch 28 on the left side of the rear armor panel carrier 14 and the other end extending from the front overlay left tunnel opening 180 with the hoop and loop patch 30 unattached.

The hoop and loop patches 26 of the right waist strap 16 attach to the corresponding hoop and loop patches 26 on the right side of the carriers 12, 14. Optionally, the hoop and loop patch 26 on one end of the left waist strap 18 is attached to the corresponding hoop and loop patch 24 on the left side of the rear armor panel carrier 14 with the hoop and loop patch 26 of the other end of the left waist strap 18 left unattached.

The wearer then dons the carrier cover 100 like a jacket, with the right arm through the right arm opening 122 and the left arm through the left arm opening 124 and pulls the front panel 104 over the wearer's torso. The free end of the left shoulder strap 20 is inserted into the front overlay left tunnel opening 180 and the hoop and loop patch 30 is mated to the corresponding hoop and loop patch 28 on the left side of the front armor carrier 12. The hoop and loop patch 26 of the free end of the left waist strap 18 is mated to the corresponding hoop and loop patch 24 on the left side of the front armor carrier 12.

The front overlay 108 is pulled over the front panel 104 and fastened to the front panel 104, preferably near the center, by an openable front fastener 240. The front fastener 240 can be any adequate openable fastener, such as a zipper 242, hook and loop fastener, or snaps. Optionally, the front fastener 240 is hidden behind a false placket 214. Using a zipper 242 as an example, one track of teeth 244 is attached vertically to the front panel 104 just left of center. The other track of teeth 246 is attached vertically to the front overlay 108 at the inside stitch 248 of the false placket 214. When the front fastener 240 is closed, it is covered by the false placket 214. The panel track of teeth 244 is left of center so that, when the front fastener 240 is closed, the false placket 214 is centrally aligned.

In this arrangement, the outside edge 250 of the false placket 214 is unattached and can flap freely. To alleviate this problem, the false placket 214 can be tacked down by a detachable fastener, such as a hook and loop fastener or, as in the present configuration, magnets 252 hidden behind the outer layer 130.

The false placket 214 can also be used to hide the front pouch vertical fastener 342, which can be positioned within the area of the front panel 104 covered by the false placket 214 or on the front panel 104 at the outside edge 250 of the false placket 214.

At this point, none of the hard armor plates are installed. The wearer goes about his business, walking, driving, etc.

Figure 25:
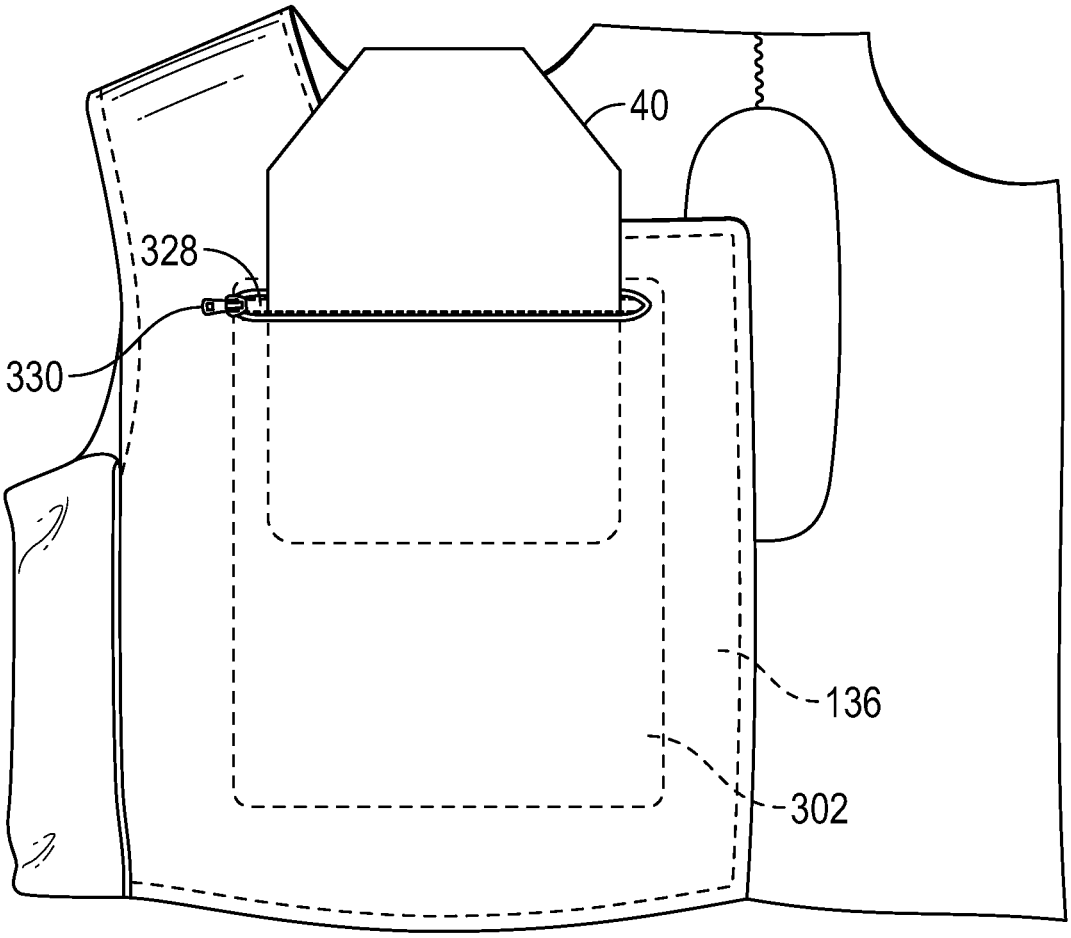
FIG. 25 is a front view in partial phantom of a carrier cover showing a partial installation of a front hard armor plate into the front pouch through a lateral opening.
Figure 26:
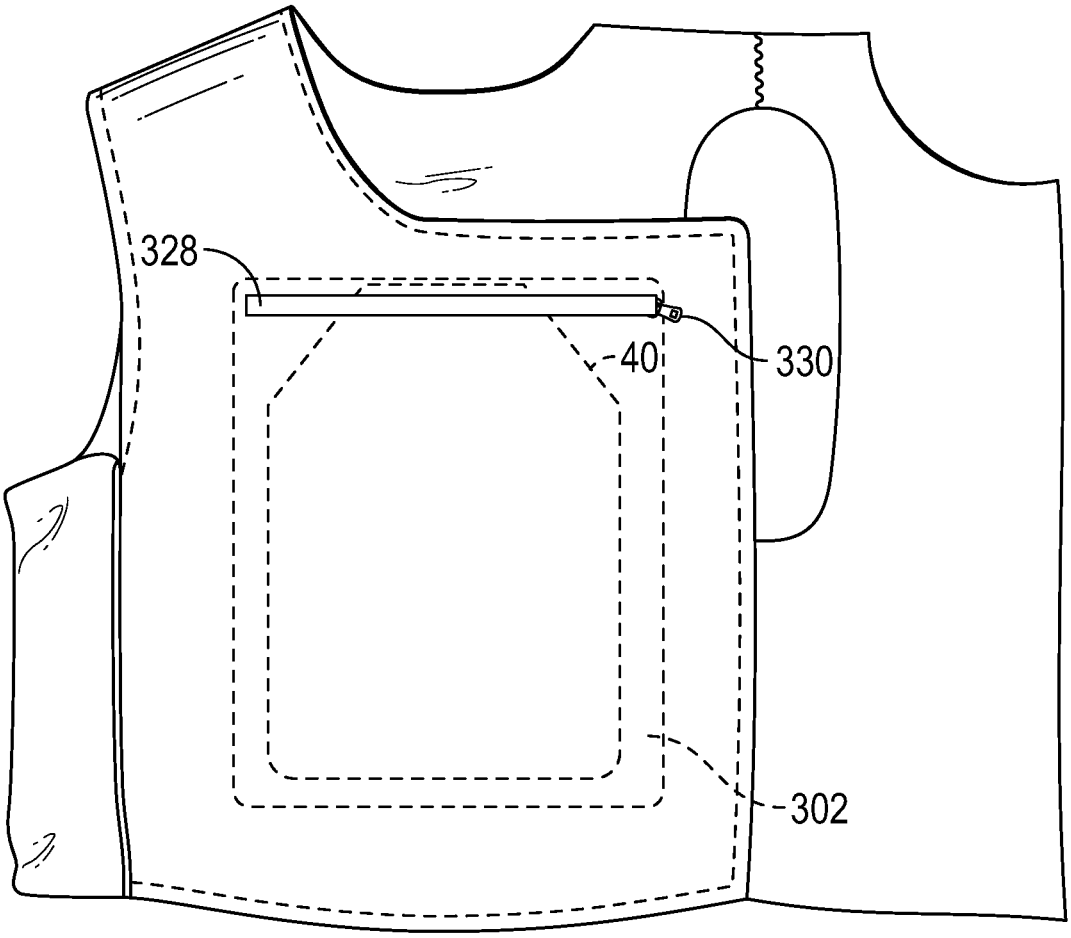
FIG. 26 is a front view in phantom of a carrier cover showing a front hard armor plate installed in the front pouch with a lateral opening.

When a situation arises where the extra protection afforded by the hard armor plates is desired, the plates can be installed without taking the carrier cover 100 off. The front pouch fastener 330, 342 is opened to gain access to the front pouch 302. The front armor plate 40 is inserted into the front pouch 302, as in FIG. 25, and the front pouch fastener 330, 342 is closed, as in FIG. 26.

Figure 27:
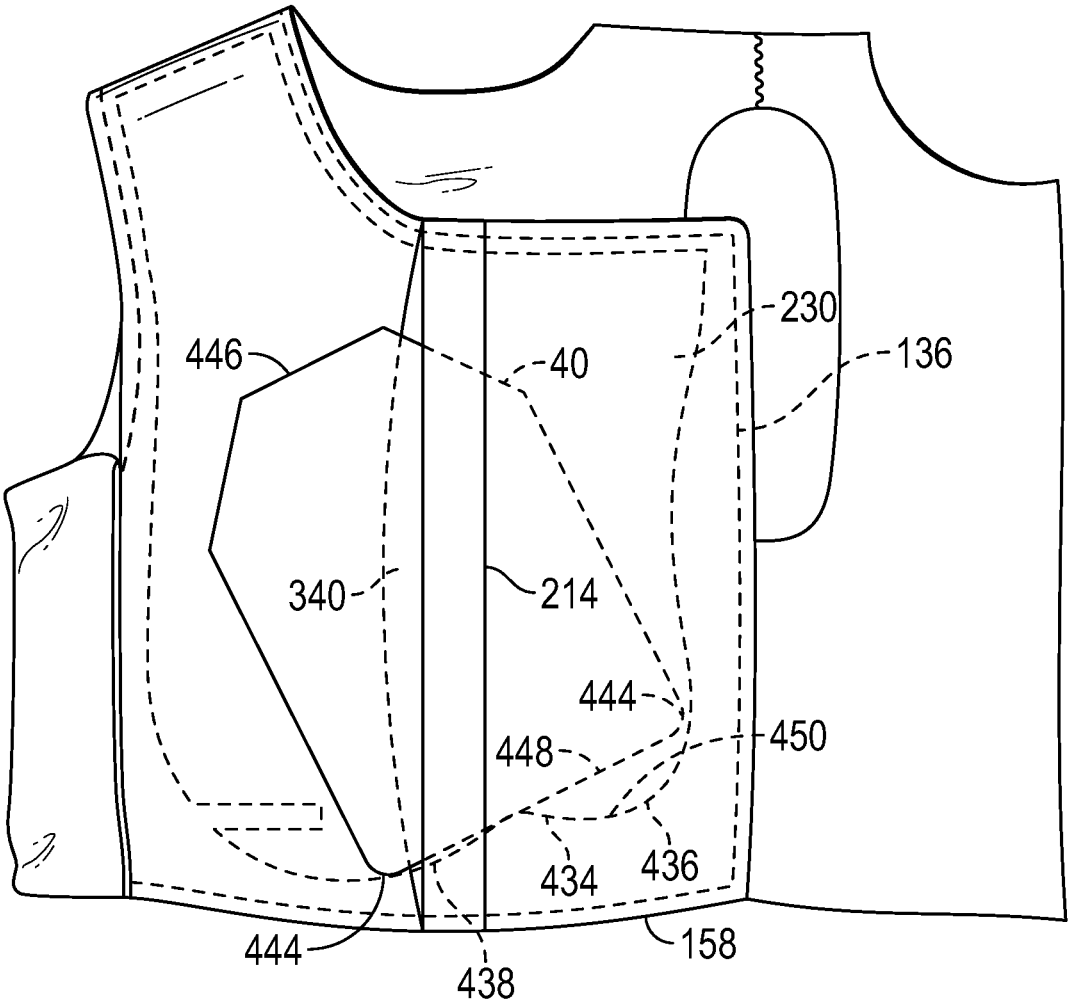
FIG. 27 is a front view of a carrier cover showing a partial installation of a front hard armor plate into the front pouch through a vertical opening at the placket in partial phantom.
Figure 28:
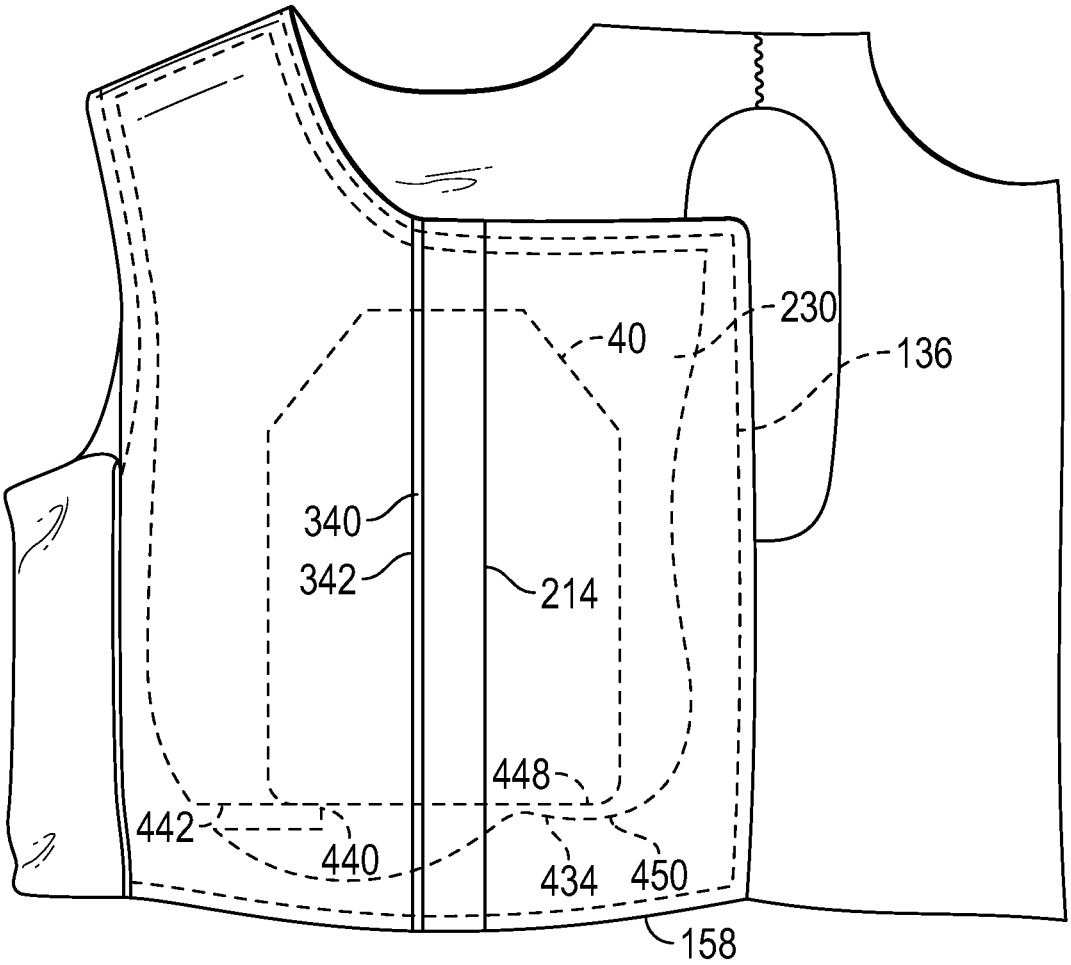
FIG. 28 is a front view of a carrier cover showing a front hard armor plate installed in the front pouch with a vertical opening at the placket in phantom.

To install the front armor plate 40 in the front pouch 302 of the shaped bag 430 of FIG. 15, the front pouch vertical fastener 342 is opened and the plate 40 is inserted diagonally into the opening 340, as in FIG. 27. The bottom left corner 444 of the plate 40 fits into the side lobe 436 and the bottom right corner 454 of the plate 40 fits into the bottom lobe 438. The lobes 436, 438 extend the size of the pouch 302 for installation. The right side of the opening 340 is pulled around the exposed part 446 of the plate 40 until the plate 40 is completely within the pouch 302. The plate 40 is rotated upwardly until the plate bottom 448 is resting on the bottom 434 of the side lobe 436 and the top side 442 of the plate support 440, as in FIG. 28, and the fastener 342 is closed.

Figure 29:
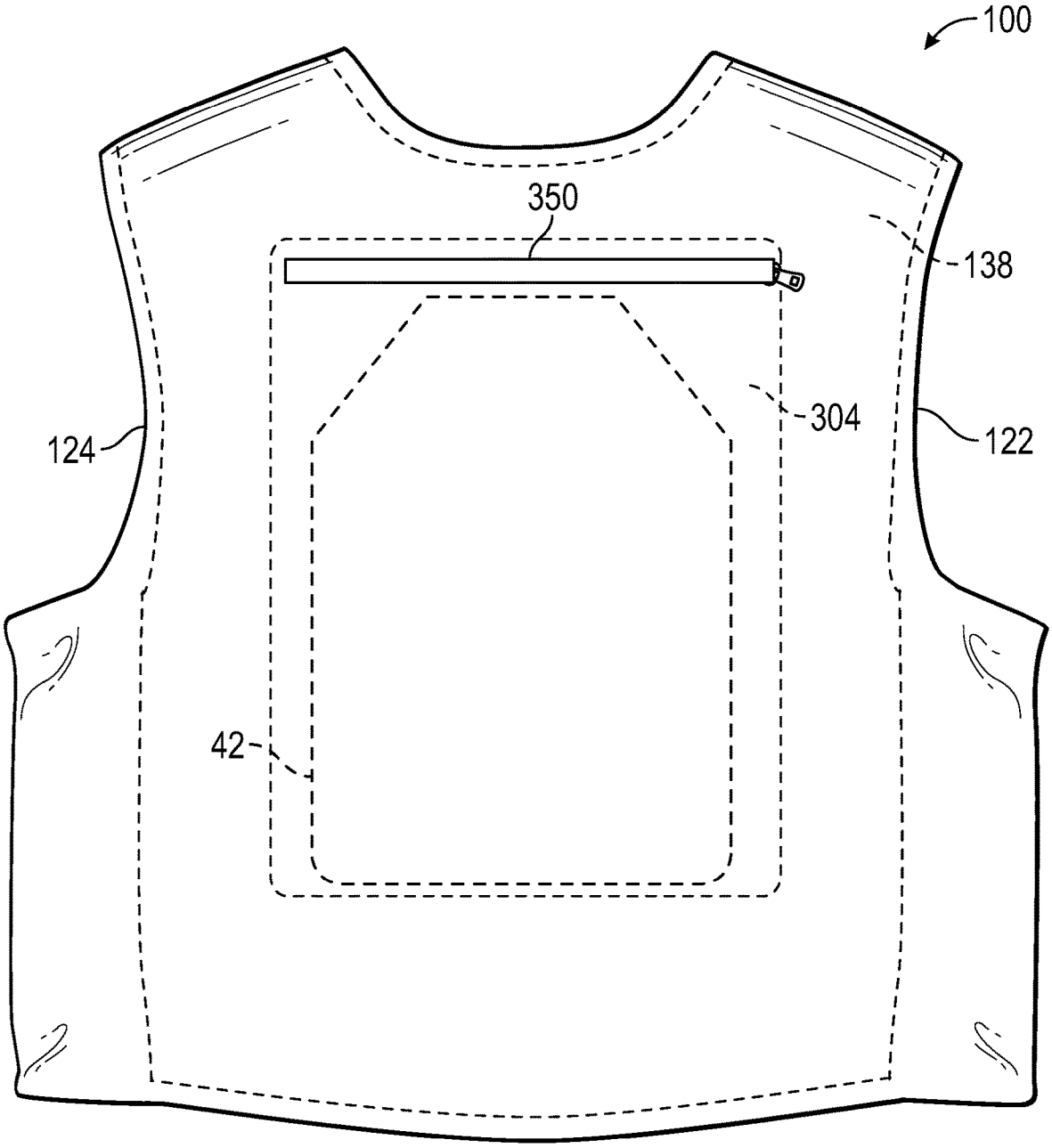
FIG. 29 is a rear view of a carrier cover showing a rear hard armor plate installed in the rear pouch in phantom.

The rear pouch fastener 352 is opened to gain access to the rear pouch 304. The rear armor plate 42 is inserted into the rear pouch 304 through the rear pouch opening 350 and the fastener 352 is closed, as in FIG. 29. If the wearer has a partner, it may be easier for the partner to install the rear armor plate 42.

If the pouches 302, 304 include sizing strips 360, the appropriate strips 360*a*, 360*b* are attached and/or detached to size the pouch 302, 304 to the armor plate 40, 42 that is being used.

Figure 30:
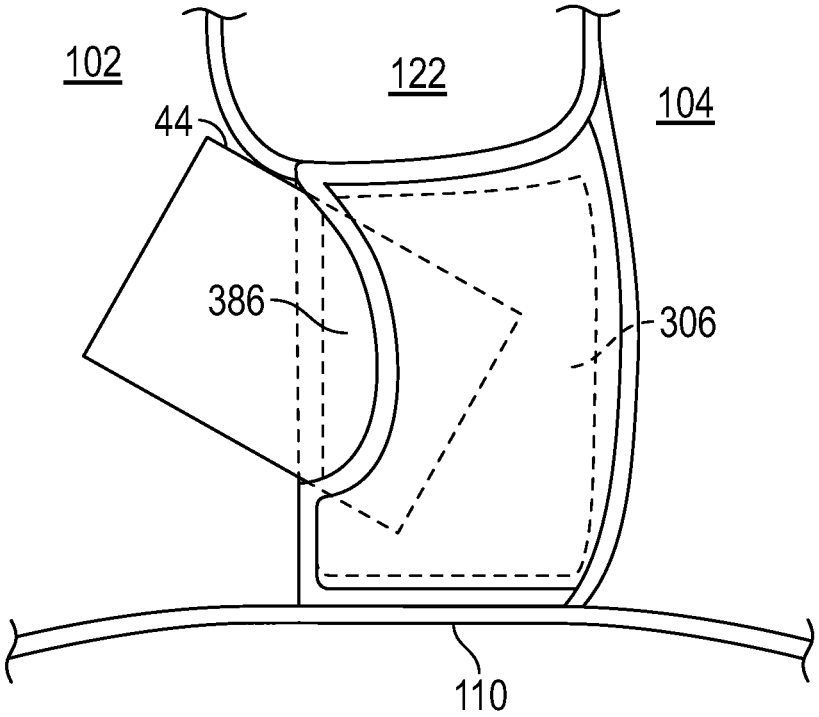
FIG. 30 is a right side view of a carrier cover showing a right side hard armor plate being installed in the right side pouch in phantom.
Figure 31:
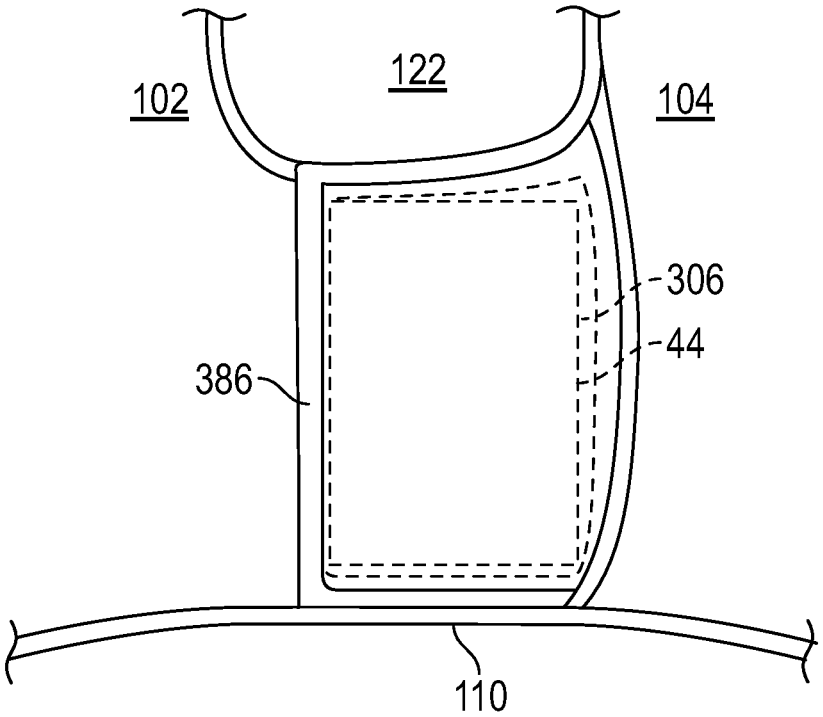
FIG. 31 is a right side view of a carrier cover showing a right side hard armor plate installed the right side pouch in phantom.

If the carrier cover 100 has the side pouches 306, 308 of FIG. 21, the front fastener 240 opened and the front overlay 108 and front panel 104 are opened to provide access to the inside of the side panels 110, 112. The right side armor plate 44 is inserted through the right side pouch opening 386 into the pouch 306, as in FIGS. 30 and 31. The left side armor plate 46 is inserted through the left side pouch opening 388 into the left side armor pouch 308. Then the front panel 104 and front overlay 108 are repositioned and the front fastener 240 is closed.

The present invention also contemplates that the hard armor plates can be installed and worn in the normal course of the day. If the hard armor plates are light enough, they will have only a small effect on the wearer.

Thus, it has been shown and described a ballistic vest carrier cover system with pouches for hard armor panels. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A cover for a ballistic vest carrier, the carrier including a front armor panel in a front portion of the ballistic vest carrier, a rear armor panel in a rear portion of the ballistic vest carrier, attachable and detachable waist straps designed to removably attach the front portion of the ballistic vest carrier to the rear portion of the ballistic vest carrier at a waist of a wearer, and attachable and detachable shoulder straps designed to removably attach the front portion of the ballistic vest carrier to the rear portion of the ballistic vest carrier at shoulders of the wearer, the cover comprising:

(a) a mantle having a rear panel extending from a rear waist of the mantle to a neck opening, a front panel attached to a right side of the rear panel and extending from a front waist to the neck opening, a front overlay attached to a left side of the rear panel and extending from the front waist to the neck opening, the front overlay removably attaching to the front panel by a front openable fastener at an edge of the front overlay opposite the rear panel;

(b) the mantle having an outer fabric layer and a liner, the liner being attached to the outer fabric layer to form a front pocket in the front panel and a rear pocket in the rear panel between the outer fabric layer and the liner, the front pocket being accessible through a right front armor opening on the right side of the front panel and through a left front armor opening on the left side of the front panel, the rear pocket being accessible through a right rear armor opening on the right side of the rear panel and through a left rear armor opening on the left side of the rear panel;

(c) whereby the front portion of the ballistic vest carrier is inserted into the front pocket, the rear portion of the ballistic vest carrier is inserted into the rear pocket, and the front portion of the ballistic vest carrier is attached to the rear portion of the ballistic vest carrier by one of the waist straps through the right front armor opening and the left front armor opening, the other waist strap through the right rear armor opening and the left rear armor opening, and by the shoulder straps.

2. The ballistic vest carrier cover of claim 1 wherein the front openable fastener is behind or at the edge of a placket extending vertically at the center of the front panel.

3. The ballistic vest carrier cover of claim 1 further comprising:

(a) a front pouch inside the front pocket accessible through a front pouch opening, the front pouch opening closable by an openable front fastener in the outer fabric layer, the front pouch being designed to receive a hard armor panel through the front pouch opening; and (b) a rear pouch inside the rear pocket, the rear pouch being accessible through a rear pouch opening closable by an openable rear fastener in the outer fabric layer, the rear pouch being designed to receive a hard armor panel through the rear pouch opening.

4. The ballistic vest carrier cover of claim 3 wherein the front pouch has a bottom, a first side, and a second side opposite the first side, the front pouch opening is vertical, and the bottom of the front pouch has a side lobe distending a lower section of the first side of the front pouch outwardly, a bottom lobe distending the bottom of the front pouch adjacent to the second side downwardly, and a plate support extending horizontally into the front pouch from the second side and aligned with the bottom of the front pouch at the side lobe.

5. The ballistic vest carrier cover of claim 4 wherein the front pouch opening is behind or at the edge of a placket.

6. The ballistic vest carrier cover of claim 1 further comprising:

(a) a right side panel attaching the front panel to the rear panel, the right side panel having an inner layer attached to an outer layer forming a right pouch therebetween, the right pouch being accessible through a right pouch opening, the right pouch designed to receive a hard armor panel through the right pouch opening; and (b) a left side panel attaching the front overlay to the rear panel, the left side panel having an inner layer attached to an outer layer forming a left pouch therebetween, the left pouch being accessible through a left pouch opening, the left pouch designed to receive a hard armor panel through the left pouch opening.

* * * * *